US010866540B2

(12) United States Patent
Morimoto

(10) Patent No.: US 10,866,540 B2
(45) Date of Patent: Dec. 15, 2020

(54) DEVELOPING DEVICE AND IMAGE FORMING DEVICE

(71) Applicant: HEWLETT-PACKARD DEVELOPMENT COMPANY, L.P., Spring, TX (US)

(72) Inventor: Kiyofumi Morimoto, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/455,033

(22) Filed: Jun. 27, 2019

(65) Prior Publication Data

US 2019/0317430 A1 Oct. 17, 2019

Related U.S. Application Data

(63) Continuation of application No. PCT/KR2017/006285, filed on Jun. 16, 2017.

(30) Foreign Application Priority Data

Dec. 27, 2016 (JP) ..... 2016-253501

(51) Int. Cl.

| | |
|---|---|
| ***G03G 15/09*** | (2006.01) |
| ***G03G 15/08*** | (2006.01) |
| ***G03G 15/16*** | (2006.01) |
| ***G03G 21/16*** | (2006.01) |

(52) U.S. Cl.

CPC ..... *G03G 15/0942* (2013.01); *G03G 15/0815* (2013.01); *G03G 15/163* (2013.01); *G03G 21/1676* (2013.01); *G03G 15/0921* (2013.01)

(58) Field of Classification Search

CPC ..... G03G 15/0815; G03G 15/0898; G03G 15/0942

See application file for complete search history.

(56) References Cited

U.S. PATENT DOCUMENTS 6,937,830 B2 * 8/2005 Satoh ..... G03G 21/203 399/92
2015/0338824 A1 * 11/2015 Shimizu ..... G03G 21/1676 399/270

FOREIGN PATENT DOCUMENTS

| | | | |
|---|---|---|---|
| JP | 10171244 | | 6/1998 |
| JP | 2010108006 A | * | 5/2010 |
| JP | 2015099268 | | 5/2015 |
| JP | 2015129905 | | 7/2015 |
| JP | 2015230344 | | 12/2015 |
| JP | 2016035545 | | 3/2016 |

* cited by examiner

*Primary Examiner* — Erika J Villaluna
(74) *Attorney, Agent, or Firm* — Staas & Halsey LLP

(57) ABSTRACT

A developing device includes a latent image carrier to form an electrostatic latent image is formed on a surface of the latent image carrier, a developing agent carrier to carry a developing agent including toner on a surface of the developing agent carrier, the developing agent carrier facing the latent image carrier, and a roll-shaped member facing the developing agent carrier to form a first gap and facing the latent image carrier to form a second gap, to form a suction air flow through the first gap and the second gap, to suction toner particles scattered to the first gap between the roll-shaped member and the developing agent carrier and the second gap between the roll-shaped member and the latent image carrier.

15 Claims, 19 Drawing Sheets

DEVELOPING DEVICE AND IMAGE FORMING DEVICE

CROSS-REFERENCE TO RELATED APPLICATIONS

This application is a continuation application of PCT International Patent Application No. PCT/KR2017/006285, filed on Jun. 16, 2017, which claims priority from Japanese Patent Application No. 2016-253501, filed on Dec. 27, 2016 in the Japanese Patent Office, the disclosures of which are incorporated herein in its entirety by reference.

BACKGROUND

In general, as a toner scattering prevention technique, that an air flow generating roller is disposed between an opening edge portion of a developing case and a photosensitive member, and by rotating the generating roller, suction air flow for sucking the toner in a lower developing area into an inner space of the developing case is increased.

DETAILED DESCRIPTION

Figure 1:
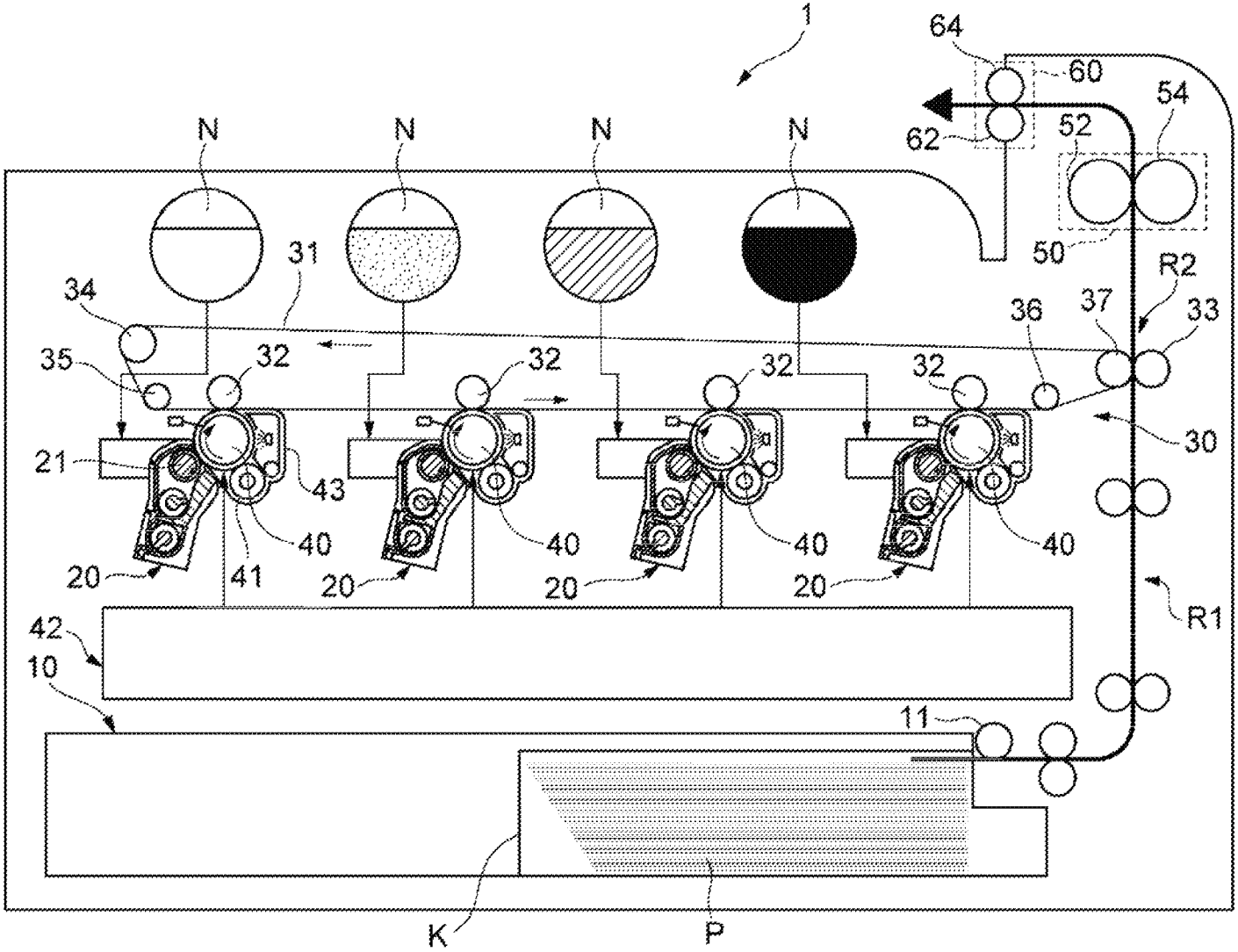
FIG. 1 is a view illustrating a brief configuration of an image forming apparatus according to an example of the disclosure.

In the meantime, in a developing device using a two-component developing agent containing a toner and a carrier as a developing agent, a trickle discharge system has been employed in order to lengthen the life of the developing agent. The trickle discharge system is a method in which new carriers are mixed and replenished into a developing agent accommodation chamber at the time of toner refill, and the old developing agent is discharged from a developing agent outlet of the developing agent accommodation chamber. The trickle discharge system is also referred to as a trickle development method, an Auto Developer Refill (ADR), or the like.

In the toner scattering prevention technique disclosed in the cited reference, the inner pressure of the inner space of the developing case is raised. For this reason, in the developing device employing the trickle discharge system, if the toner scattering prevention technique disclosed in the cited reference is employed, A developing agent may be excessively discharged from a developing agent outlet.

Therefore, the disclosure is to provide a developing device capable of suppressing the scattering of a toner while suppressing the excessive discharge of a developing agent, and an image forming apparatus.

According to an example of the disclosure to achieve the above-described object, a developing device includes a latent image carrier in which an electrostatic latent image is formed on a surface, a developing case configured to accommodate a developing agent including toner and a carrier, a developing agent carrier in which the developing agent is carried on a surface, the developing agent carrier facing the latent image carrier, and a roll-shaped member configured to, by facing the developing agent carrier and the latent image carrier, form a suction air flow for sucking toner scattered to a gap between the roll-shaped member and the developing agent carrier and a gap between the roll-shaped member and the latent image carrier.

An interval A between the developing agent carrier and the roll-shaped member and an interval B between the latent image carrier and the roll-shaped member may satisfy a relation of 0.5 mm≤interval A≤1.1 mm and 0≤interval B/interval A≤0.9.

The developing device has a roll-shaped member which faces the developing agent carrier and the latent image carrier, and at a gap between the developing agent carrier and the roll-shaped member and a gap between the latent image carrier and the roll-shaped member, suction air for sucking toner into the developing case is generated. The roll-shaped member has a circular cross section and thus an area where the gap is decreased can be reduced. By this, pressure loss of suction area in the gap can be decreased, toner can be efficiently recollected to the developing case.

By satisfying the relation of 0.5 mm≤interval A≤1.1 mm, the pressure loss of the suction air flow generated between the developing agent carrier and the roll-shaped member is reduced, and the toner can be efficiently recollected into the developing case. In addition, since the air velocity of the suction air flow is increased only between the developing agent carrier and the roll-shaped member, and the air amount of the suction air flow remains unchanged, the excessive discharge of the developing agent from the developing agent discharge outlet can be suppressed.

By satisfying the relation of 0<interval B/interval A≤0.9, it is possible to generate a sufficient suction air flow between the latent image carrier and the roll-shaped member for suppressing the scattering of the toner. Through this, scattering of the toner between the latent image carrier and the roll-shaped member can be suppressed.

The developing agent carrier may transfer a carried developing agent to a developing area in which the developing agent carrier faces the latent image carrier and develop an electrostatic latent image of the latent image carrier. The transfer amount of the developing agent of the developing agent carrier transferred to the developing area can be 300 $g/m^2$ or more and 700 $g/m^2$ or less. The developing agent is carried on the developing agent carrier, is in a spike-standing shape, and generates suction air between the developing agent carrier and the roll-shaped member. In the developing device, the transfer amount of the developing agent of the developing agent carrier transferred to the developing area may be 300 $g/m^2$ or more and suction air can be sufficiently generated. Accordingly, toner can be sucked into the developing device. In the meantime, the transfer amount of the developing agent of the developing agent carrier transferred to the developing area may be 700 $g/m^2$ or below, and the developing agent may be carried on the developing agent carrier in a spike-standing shape and scattering of toner can be suppressed.

According to an example, the developing device further may include a carrying amount regulating member which regulates a carrying amount of the developing agent that is carried on the developing agent carrier. By including the carrying amount regulating member, the developing device may appropriately adjust the transfer amount of the developing agent carrier transferred to the developing area.

According to an example, an interval B which is a distance between the latent image carrier and the roll-shaped member may be 0 mm<interval B≤1.0 mm. In this developing device, the interval B between the latent image carrier and the roll-shaped member is 0 mm<interval B≤1.0 mm, suction air that is sufficient to suppress scattering of toner can be generated between the latent image carrier and the roll-shaped member. Through this, scattering of toner between the latent image carrier and the roll-shaped member can be suppressed.

When an interval between the developing agent carrier and the developing case is C, the relation of C/interval A≥1.4 can be satisfied, at least in a proximity of the roll-shaped member. The developing device satisfies the relation of interval C/interval A≥1.4, the pressure loss of the air flow sucked into the developing case may be reduced. Therefore, toner can be sucked or suctioned into the developing case efficiently.

The developing agent carrier includes a developing sleeve which forms a surface layer of the developing agent carrier and a magnet which is disposed inside the developing sleeve and has a plurality of magnetic poles in a circumferential direction. The magnet includes a first magnetic which is adjacent to a circumferential direction and a second magnetic pole having a polarity opposite to the first magnetic pole, and the roll-shaped member may be positioned at a gap between the first magnetic pole and the second magnetic pole. At a gap between the first magnetic pole and the second magnetic pole, the spike-standing shape of the developing agent may be folded. Therefore, in the developing device, by disposing the roll-shaped member at the gap between the first magnetic pole and the second magnetic pole, a chance that the developing agent carried on the developing agent carrier is in contact with the roll-shaped member can be reduced. Through this, scattering of toner attributable to contacting the developing agent carried on the developing agent carrier with the roll-shaped member can be suppressed.

The roll-shaped member may be positioned within a range of ±20° in a circumferential direction of the developing agent carrier, with respect to a position in which an absolute value of a magnetic force component in a normal line direction of the developing agent carrier becomes a minimum value in a gap between the first magnetic pole and the second magnetic pole. In this developing device, the roll-shaped member is positioned within a range of ±20° in a circumferential direction of the developing agent carrier, with respect to a position in which an absolute value of a magnetic force component in a normal line direction of the developing agent carrier becomes a minimum value in a gap between the first magnetic pole and the second magnetic pole, the amount of contact between the spike-standing developing agent and the developing agent carrier. By this, scattering of toner can be suppressed while degree of freedom of disposition of the roll-shaped member and the workability of installation are being improved.

The roll-shaped member may be made of a non-magnetic member. In this developing device, the roll-shaped member is non-magnetic, and it can be suppressed that the roll-shaped member is magnetized by the magnetic force of the developing agent carrier and the developing agent is attached to the roll-shaped member. Through this, for example, it may be prevented that the suction air flow from being suppressed by attaching the developing agent to the roll-shaped member and that the toner which is attached to the roll-shaped member from being re-attached to the latent image carrier.

An arithmetic average roughness of a surface of the roll-shaped member may be 10 μm or less. In this developing device, the arithmetic average roughness Ra of the surface of the roll-shaped member is 10 μm, it can be suppressed that suction air is inhibited as air flow on a surface of the roll-shaped member is disturbed.

An end of the roll-shaped member is interleaved to a cylindrical member, and the cylindrical member may be in contact with a surface of the latent image carrier. In this developing device, the cylindrical member which is installed in the roll-shaped member is in contact with the surface of the latent image carrier and thus, a distance between the roll-shaped member and the latent image carrier can be controlled with the thickness of the cylindrical member. By this, while avoiding increasing the number of components to adjust the distance between the roll-shaped member and the latent image carrier, the position of the roll-shaped member with respect to the latent image carrier can be determined precisely.

The developing device may further include a bias applying unit for applying, to the roll-shaped member, a bias voltage. In this developing device, in order to apply the bias voltage to the roll-shaped member, attaching the scattered toner to the roll-shaped member can be suppressed. Through this, for example, it can be avoided attaching a developing agent to a roll-shaped member which may suppress suction air and re-attaching the toner which is attached to a roll-shaped member to a latent image carrier. The bias applying unit may apply a bias voltage having an absolute value larger than that of the bias voltage applied to the developing agent carrier and a bias voltage having a smaller absolute value than a surface potential of the latent image carrier to the roll-shaped member. In this developing device, a bias voltage having an absolute value that is greater than the bias voltage applied to the developing agent carrier is applied to the roll-shaped member and thus, attaching scattered toner or carrier to the roll-shaped member can be suppressed. Through this, for example, it can be avoided attaching a developing agent to a roll-shaped member which may suppress suction air and re-attaching the toner which is attached to a roll-shaped member to a latent image carrier. In addition, a bias voltage having an absolute value that is smaller than the surface potential is applied to the roll-shaped member and thus, it can be suppressed that the latent image carried on the latent image carrier is disturbed.

The roll-shaped member may rotate with respect to the central axis of the roll-shaped member. In this developing device, if a developing agent is attached to the roll-shaped member, it can be suppressed that the developing agent is stacked on a certain area of the roll-shaped member by rotating the roll-shaped member. In addition, the developing agent attached to the roll-shaped member is removed by suction air, the developing agent attached to the entire circumferential surfaces of the roll-shaped member can be removed by suction air.

In this developing device, the average particle diameter of the carrier is 20 μm or more and 40 μm or less, it can be prevented that the developing agent from being excessively discharged from the developing case 24 with maintaining high quality of image.

The image forming apparatus according to the disclosure includes one developing device. Accordingly, excessive discharge of a developing agent from a developing device can be suppressed and the scattering of toner can be suppressed at the same time. According to the disclosure, excessive discharge of a developing agent from a developing device can be suppressed and the scattering of toner can be suppressed at the same time.

The above and other features of the disclosure will become more apparent by describing in detail examples thereof with reference to the attached drawings. In addition, the same reference numerals are assigned to the same or corresponding parts in each drawing, and redundant explanations are omitted.

A simple configuration of an image forming apparatus according to an example of the disclosure is described. As shown in FIG. 1, an image forming apparatus 1 is a device for forming a color image using each color of magenta, yellow, cyan, and black. The image forming apparatus 1 can be configured as an apparatus for forming a black and white image by using a black color or an image forming apparatus using various colors. The image forming apparatus 1 includes a transfer device 10 for transferring a sheet of paper P, which is a recording medium, a developing device 20 for developing an electrostatic latent image, a transfer device 30 for secondarily transcribing a toner image onto the paper P, a latent image carrier 40 in which an electrostatic latent image is formed on a surface (circumferential surface), a fixing device 50 for fixing the toner image onto the paper P, and a discharging device 60 for discharging the paper P.

The transfer device 10 transfers the paper P as a recording medium on which an image is formed on a transfer path R1. The paper P is stacked and accommodated in a cassette K, picked up by a paper feed roller 11, and transferred. The transfer device 10, at the timing at which the toner image transferred to the paper P reaches a transfer nip portion R2, brings the paper P to reach the nip portion R2 through the transfer path R1.

Four developing devices 20 are provided for each color. Each developing device 20 is provided with a developing agent carrier 21 for carrying the toner on a latent image carrier 40. In the developing device 20, a two-component developing agent containing toner and a carrier is used as a developing agent. That is, in the developing device 20, the toner and the carrier are adjusted so as to have a certain mixing ratio, and further mixed and stirred to uniformly disperse the toner to adjust the developing agent to which the optimum amount of charge is given. The developing agent is carried on the developing agent carrier 21. When the developing agent is transferred to an area facing the latent image carrier 40 by rotation of the developing agent carrier 21, the toner in the developing agent carried on the developing agent carrier 21 is moved to the electrostatic latent image formed on the peripheral surface (circumferential surface) of the latent image carrier 40, and the electrostatic latent image is developed.

The transfer device 30 transfers the toner image formed by the developing device 20 to the transfer nip portion R2 for secondary transfer of the toner image onto the paper P. The transfer device 30 includes a transfer belt 31 on which the toner image is primarily transferred from the latent image carrier 40, suspension rollers 34, 35, 36, and 37 for suspending the transfer belt 31, a primary transfer roller 32 for holding the transfer belt 31 together with the latent image carrier 40 and a secondary transfer roller 33 for holding the transfer belt 31 together with the suspension roller 37.

The transfer belt 31 is an endless belt that circulates by the suspension rollers 34, 35, 36, 37. The suspension rollers 34, 35, 36, 37 are rollers rotatable in the respective central axis directions. The suspension roller 37 is a driving roller that is capable of rotating in the direction of the central axis and the suspension rollers 34, 35 and 36 are driven rollers that are driven to rotate by the rotation of the suspension roller 37. The primary transfer roller 32 is installed so as to press the latent image carrier 40 from the inner circumferential side of the transfer belt 31. The secondary transfer roller 33 is disposed in parallel with the suspension roller 37 with the transfer belt 31 interposed therebetween so as to press the suspension roller 37 from the outer circumferential side of the transfer belt 31. As a result, the secondary transfer roller 33 forms the transfer nip R2 between the transfer belt 31 and the secondary transfer roller 33.

The latent image carrier 40 is also referred to as an electrostatic latent image carrier, a photoreceptor drum, and the like. Four latent image carriers 40 are provided for each color. Each latent image carrier 40 is provided according to a movement direction of the transfer belt 31. On a circumference of the latent image carrier 40, the developing device 20, a charging roller 41, an exposure unit 42, and a cleaning unit 43 are provided.

The charging roller 41 is charging means for uniformly charging the surface of the latent image carrier 40 at a predetermined potential. The charging roller 41 moves, following the rotation of the latent image carrier 40. The exposure unit 42 exposes the surface of the latent image carrier 40 charged by the charging roller 41 according to an image formed on the paper P. As a result, the potential of the exposed portion of the surface of the latent image carrier 40 exposed by the exposure unit 42 changes, and an electrostatic latent image is formed. The four developing devices 20 develop the electrostatic latent image formed on the latent image carrier 40 by the toner supplied from a toner tank N provided to face each of the developing devices 20, and generate a toner image. Each of the toner tanks N is filled with magenta, yellow, cyan and black toners, respectively. The cleaning unit 43 recovers the toner remaining on the latent image carrier 40 after the toner image formed on the latent image carrier 40 is primarily transferred to the transfer belt 31.

The fixing device 50 attaches and fixes, to the paper P, the toner image secondarily transferred from the transfer belt 31 to the paper P by passing the paper P through the fixing nip portion for heating and pressing. The fixing device 50 includes a heating roller 52 for heating the paper P and a pressure roller 54 for pressing and rotating the heating roller 52. The heating roller 52 and the pressure roller 54 are formed in a cylindrical shape and the heating roller 52 has a heat source such as a halogen lamp inside. Between the heating roller 52 and the pressure roller 54, there is provided a fixing nip portion which is a contact area, and the toner image is fused and fixed to the paper P by passing the paper P through the fixing nip portion.

The discharging device 60 includes discharging rollers 62 and 64 to discharge the paper P in which the toner image is fixed to outside.

Next, a printing process according to the image forming apparatus 1 will be described. When an image signal of the recorded image of the image forming apparatus 1 is input, a controller of the image forming apparatus 1 rotates the paper feed roller 11 to pick up the paper P stacked on the cassette K and transfers the same. Based on the received image signal, the surface of the latent image carrier 40 is uniformly charged to a predetermined potential by the charging roller 41 (charging step). Thereafter, the surface of the latent image carrier 40 is irradiated with laser light by the exposure unit 42 to form an electrostatic latent image (exposing step).

In the developing device 20, the electrostatic latent image is developed and a toner image is formed (developing step). The toner image thus formed is primarily transferred from the latent image carrier 40 to the transfer belt 31 in an area where the latent image carrier 40 and the transfer belt 31 face each other (transferring step). On the transfer belt 31, toner images formed on the four latent image carriers 40 are successively stacked, and one stacked toner image is formed. The stacked toner image is secondarily transferred onto the paper P transferred from the transfer device 10 in the transfer nip portion R2 where the suspension roller 37 and the secondary transfer roller 33 face each other. The paper P onto which the stacked toner images have been secondarily transferred is transferred to the fixing device 50. The fixing device 50 heats and pressurizes the paper P between the heating roller 52 and the pressure roller 54 when the paper P passes the fixing nip portion so that the stacked toner image is fused and fixed to the paper P (fixing step). Thereafter, the paper P is discharged to the outside of the image forming apparatus 1 by the discharging rollers 62 and 64.

An example of the disclosure will be described.

Figure 2:
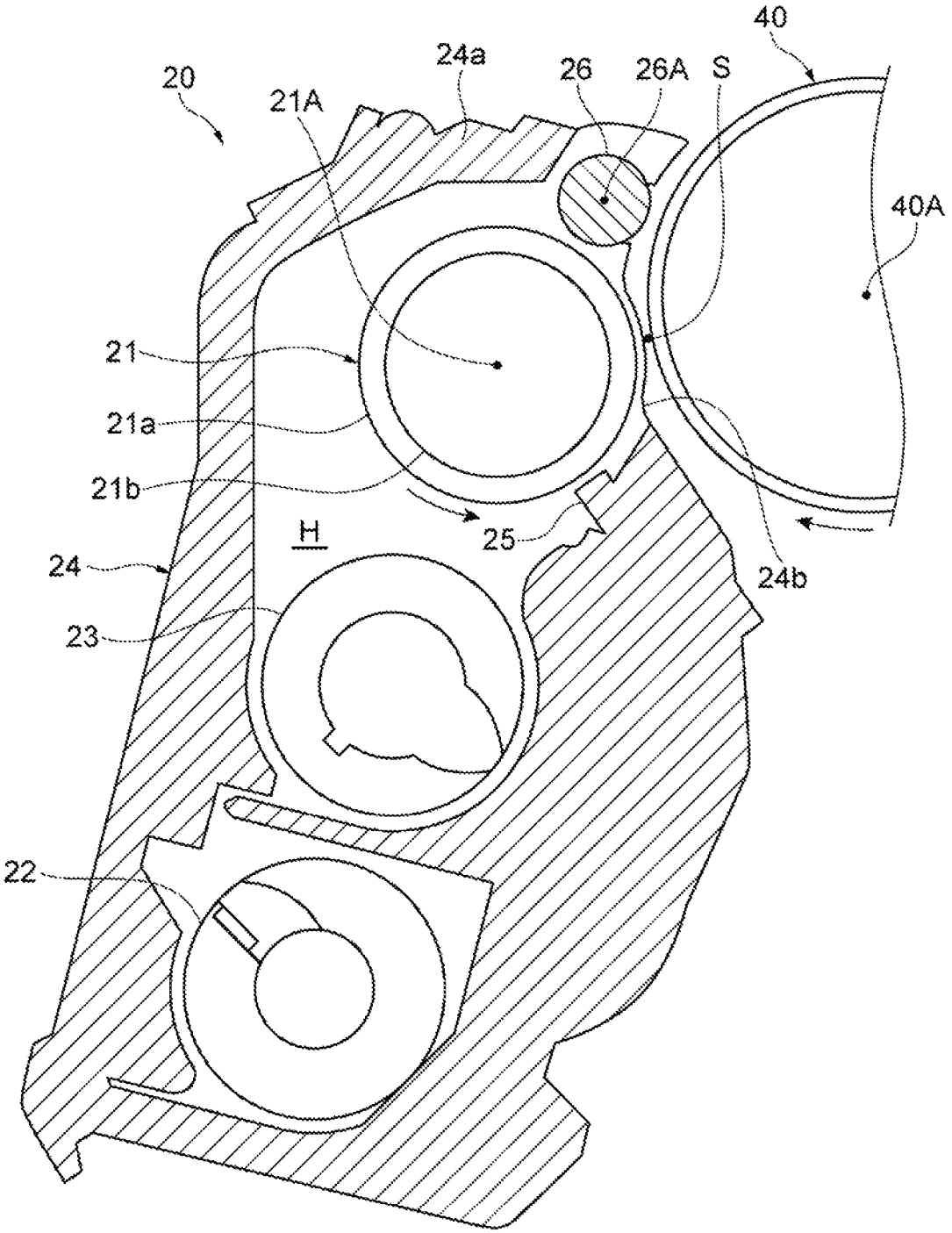
FIG. 2 is a schematic cross-sectional view of an image forming apparatus according to an example of the disclosure.

As illustrated in FIG. 2, the developing device 20 includes the latent image carrier 40, a developing agent carrier 21, a first agitating and transferring member 22, a second agitating and transferring member 23, the developing case 24, a carrying amount regulating member 25, and a roll-shaped member 26. The developing agent carrier 21, the first agitating and transferring member 22, the second agitating and transferring member 23, and the carrying amount regulating member 25 are disposed in a developing agent accommodation chamber H formed by the developing case 24.

The first agitating and transferring member 22 and the second agitating and transferring member 23 agitate a magnetic carrier and a nonmagnetic toner constituting the developing agent in the developing agent accommodation chamber H and make the carrier and the toner triboelectrically charged. The first agitating and transferring member 22 and the second agitating and transferring member 23 agitate and transfer the developing agent in the developing agent accommodation chamber H.

The developing agent carrier 21 faces the latent image carrier 40. That is, a central axis 21A of the developing agent carrier 21 and a central axis 40A of the latent image carrier 40 are parallel to each other and an interval between the developing agent carrier 21 and the latent image carrier 40 is the same along the direction of the central axis 21A (the direction of the central axis 40A). The developing agent carrier 21 carries the developing agent agitated on the first agitating and transferring member 22 and the second agitating and transferring member 23 on the surface. The developing agent carrier 21 develops the electrostatic latent image of the latent image carrier 40 by transferring the carried developing agent to the developing area S. The developing area S is an area where the developing agent carrier 21 and the latent image carrier 40 face each other and is an area where the toner carried by the developing agent carrier 21 is supplied to the latent image carrier 40. That is, the developing area S is the area in which the developing agent carrier 21 and the latent image carrier 40 are closest to each other.

More specifically, the developing agent carrier 21 includes a developing sleeve 21*a* for forming a surface layer of the developing agent carrier 21 and a magnet 21*b* disposed inside the developing sleeve 21*a*. The developing sleeve 21*a* is a tubular member made of a non-magnetic metal. In the developing agent carrier 21, the developing sleeve 21*a* may rotate about the central axis 21A while the magnet 21*b* may not. The magnet 21*b* disposed in the developing sleeve 21*a* is fixed to the developing case 24. The developing agent is carried on the surface of the developing sleeve 21*a* by the magnetic force of the magnet 21*b*. The developing agent carrier 21 transfers the developing agent in the rotating direction of the developing sleeve 21*a* by rotating the developing sleeve 21*a*.

Figure 3:
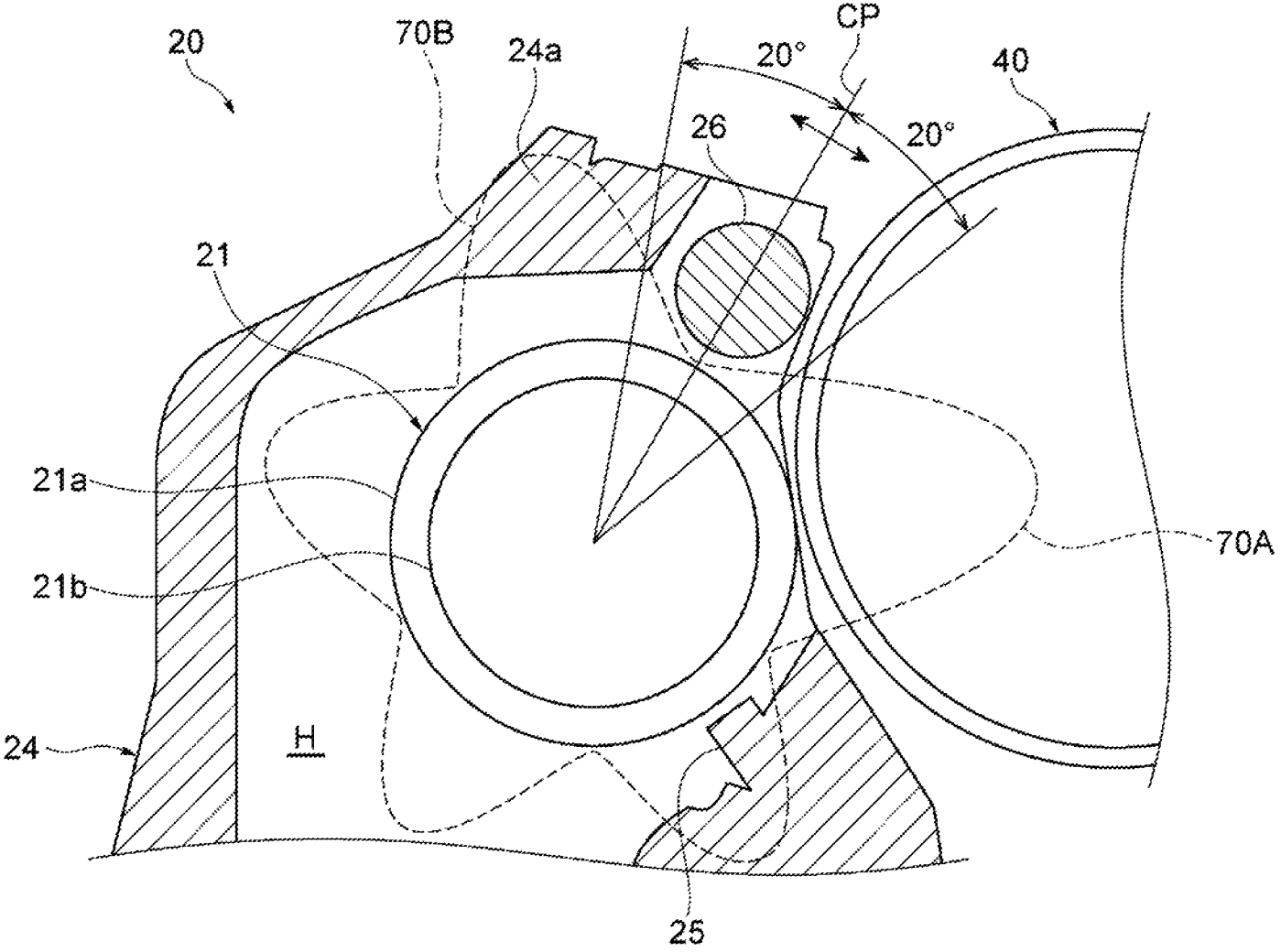
FIG. 3 is a view to describe the magnetic pole illustrated in FIG. 2.

As shown in FIG. 3, the magnet 21*b* has a plurality of magnetic poles in the circumferential direction of the developing agent carrier 21. The magnet 21*b* has at least a first magnetic pole 70A and a second magnetic pole 70B which are adjacent to each other in the circumferential direction of the developing agent carrier 21. The first magnetic pole 70A is a magnetic pole located in the developing area S. The second magnetic pole 70B is a magnetic pole located on the downstream side of the rotation direction of the developing sleeve 21*a* with respect to the first magnetic pole 70A and adjacent to the first magnetic pole 70A. The first magnetic pole 70A and the second magnetic pole 70B may have opposite polarities.

On the developing sleeve 21*a*, the developing agent is attached to form a specific shape by the magnetic force of each magnetic pole of the magnet 21*b*. For example, on the developing sleeve 21*a*, the developing agent may be attached in a spike-standing shape by the magnetic forces of the magnetic poles of the magnet 21*b*, and a magnetic brush in a spike-standing shape is formed. Hereinafter, for convenience of description, the developing agent attached to the developing sleeve 21*a* by the magnetic force of the magnet 21*b* in the spike-standing shape is collectively referred to as a spike-standing developing agent. The developing agent carrier 21 brings the spike-standing developing agent formed by the first magnetic pole 70A to contact with or approach the electrostatic latent image on the latent image carrier 40 in the developing area S. As a result, the toner in the developing agent carried on the developing agent carrier 21 moves to the electrostatic latent image formed on the circumferential surface of the latent image carrier 40, and the electrostatic latent image is developed.

As shown in FIG. 2, the carrying amount regulating member 25 regulates the amount of the developing agent carried on the developing agent carrier 21. The carrying amount regulating member 25 is provided on an upper side in the rotational direction of the developing sleeve 21*a* with respect to the developing area S. The carrying amount regulating member 25 is located on the lower side of the central axis 21A of the developing agent carrier 21. The carrying amount regulating member 25 is provided such that a certain gap is formed between the carrying amount regulating member 25 and the developing sleeve 21*a*. Therefore, the carrying amount regulating member 25 makes the layer thickness of the developing agent carried on the circumferential surface of the developing sleeve 21*a* flattened (regulates the layer thickness) to a uniform thickness layer by rotating the developing sleeve 21*a*. By adjusting the interval between the carrying amount regulating member 25 and the developing sleeve 21*a*, the transfer amount of the developing agent of the developing agent carrier 21 transferred to the developing area S can be adjusted.

Here, the transfer amount (developing agent transfer amount) of the developing agent in the developing agent carrier 21 transferred to the developing area S may be 300 $g/m^2$ or more, may be 350 $g/m^2$ or more, and may be 400 $g/m^2$ or more. In addition, the transfer amount of the developing agent of the developing agent carrier 21 transferred to the developing area S may be 700 $g/m^2$ or less, may be 650 $g/m^2$ or less, and may be 600 $g/m^2$ or less. In other words, the transfer amount of the developing agent carried on the developing agent carrier 21 to be transferred to the developing area S may be 300 $g/m^2$ to 700 $g/m^2$, may be 350 $g/m^2$ to 650 $g/m^2$, and may be 400 $g/m^2$ to 600 $g/m^2$.

The developing case 24 accommodates the developing agent carrier 21, the first agitating and transferring member 22, the second agitating and transferring member 23, and the carrying amount regulating member 25. The developing case 24 forms a developing agent accommodation chamber H for containing a developing agent including a toner and a carrier. The developing case 24 has an opening 24*b* formed at a position where the developing agent carrier 21 faces the latent image carrier 40. The toner in the developer storage chamber H is supplied from the opening 24*b* to the latent image carrier 40.

The upper portion of the developing agent carrier 21 is covered with a upper case wall 24*a* of the developing case 24. When the developing agent carrier 21 rotates, air is sucked into the developing case 24 between the developing agent carrier 21 and the upper case wall 24*a* in accordance with the movement of the spike standing developing agent formed on the developing sleeve 21*a*. The developing case 24 is provided with a developing agent discharging port (not shown) for discharging the old developing agent from the developing agent storage chamber H.

A roll-shaped member 26 is an elongated, cylindrical member and extends in a direction parallel to the central axis 21A of the developing agent carrier 21. In other words, the shape of the roll-shaped member 26 in the cross section perpendicular to the central axis 21A is in a circular shape. In this case, the circular cross section of the roll-shaped member 26 may be a completely circular shape.

The roll-shaped member 26 faces the developing agent carrier 21 and the latent image carrier 40. That is, the central axis 26A of the roll-shaped member 26, the central axis 21A of the developing agent carrier 21, and the central axis 40A of the latent image carrier 40 are parallel to each other. An interval between the roll-shaped member 26 and the developing agent carrier 21 is the same along the direction of the central axis 21A of the developing agent carrier 21, and an interval between the roll-shaped member 26 and the latent image carrier 40 is the same along the direction of the central axis 40A of the latent image carrier 40. A gap is formed between the roll-shaped member 26 and the developing agent carrier 21, and no other member is disposed in the gap. A gap is formed between the roll-shaped member 26 and the latent image carrier 40, and no other member is disposed therebetween.

The roll-shaped member 26 forms a flow path for air between the latent image carrier 40 and the developing agent carrier 21. The suction air stream for sucking the scattered toner into the developing agent accommodation chamber H in the developing case 24 passes through the gap between the developing agent carrier 21 and the roll-shaped member 26 and the gap between the latent image carrier 40 and the roll-shaped members 26.

As shown in FIG. 3, the position of the roll-shaped member 26 in the circumferential direction of the developing agent carrier 21 is not particularly limited, but the roll-shaped member 26 may be located in the gap between the first magnetic pole 70A and the second magnetic pole 70B. The gap between the first magnetic pole 70A and the second magnetic pole 70B is the distance between the first magnetic pole 70A and the second magnetic pole 70B and a position that the magnetic force in the radial direction of the developing agent carrier 21 is decreased. The position where the absolute value of the magnetic force component in the normal line direction of the developing agent carrier 21 becomes the minimum value in the gap between the first magnetic pole 70A and the second magnetic pole 70B is referred to as the inter-pole central position CP. In this case, it may be that the roll-shaped member 26 is located within a range of ±20° in the circumferential direction of the developing agent carrier 21 with respect to the inter-pole central position CP, may be in the range of ±15° in the circumferential direction of the developing agent carrier 21, and may be in the range of ±10° in the circumferential direction of the developing agent carrier 21. The range of ±20° in the circumferential direction of the developing agent carrier 21 means that, with respect to the inter-pole central position CP, the range from 20° at an upper side in the rotational direction of the developing sleeve 21*a* to 20° at a lower side in the rotational direction of the developing sleeve 21*a*.

The roll-shaped member 26 may be made to be non-magnetic. A non-magnetic material forming the roll-shaped member 26 is, for example, SUS304.

The arithmetic average roughness Ra of the surface of the roll-shaped member 26 may be 10 μm or less, may be 9 μm or less, and may be 8 μm or less.

Figure 4:
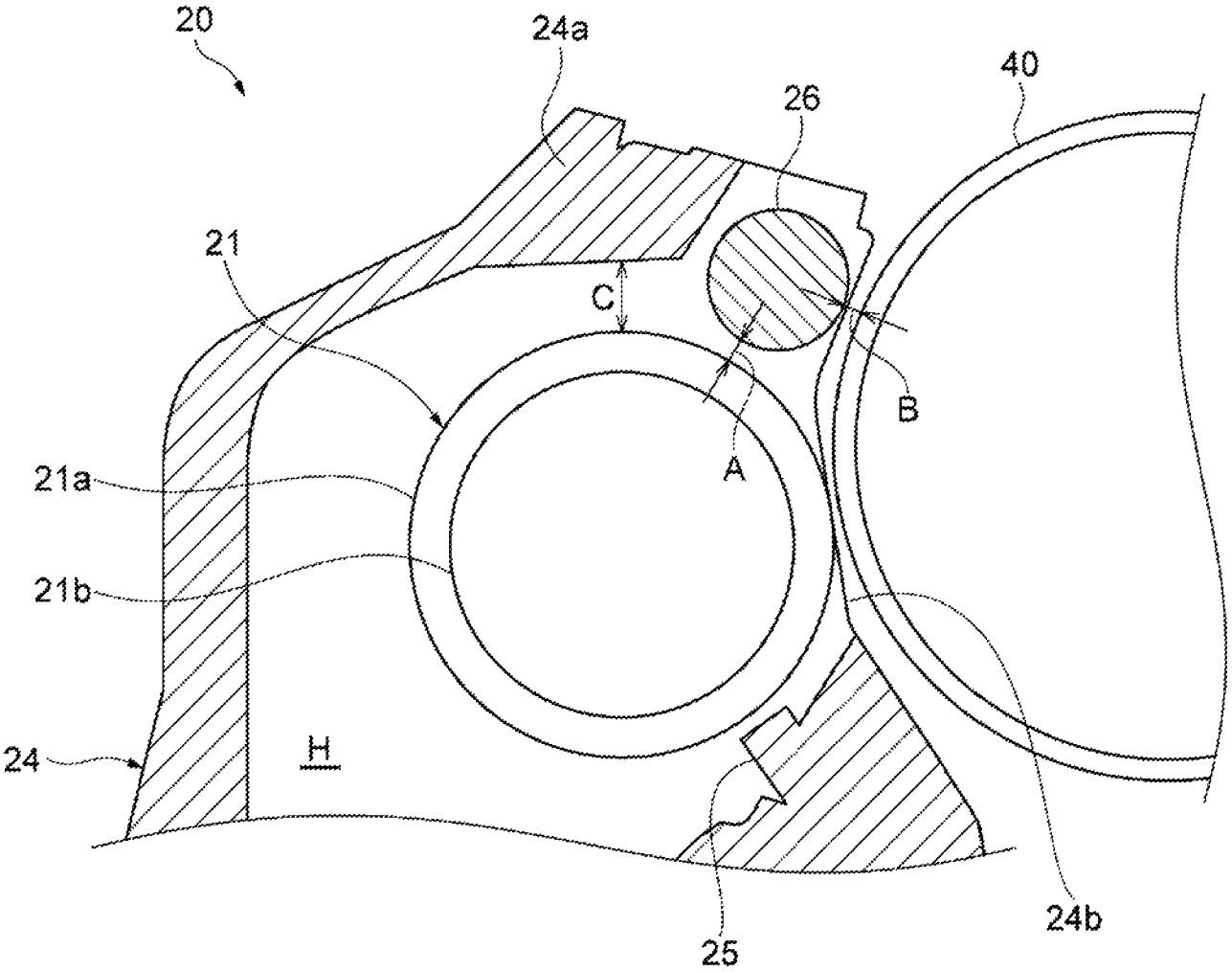
FIG. 4 is a view to describe a positional relation among the latent image carrier, the developing agent carrier, and the roll-shaped member.

As illustrated in FIG. 4, the interval between the developing agent carrier 21 and the roll-shaped member 26 is set to be equal to the interval A, and the interval between the latent image carrier 40 and the roll-shaped member 26 is set to be interval B, and the interval between the developing agent carrier 21 and the developing case 24 is set to be interval C. The interval C is a distance between the position closest to the developing agent carrier 21 of the developing case 24 and the developing agent carrier 21, and concretely the distance between the developing agent carrier 21 and the upper case wall 24*a*.

The developing agent carrier 21, the latent image carrier 40 and the roll-shaped member 26 are disposed to satisfy the relation of 0.5 mm≤interval A≤1.1 mm, and 0≤interval B/interval A≤0.9. In this case, it may be to satisfy the relation of 0.6 mm≤interval A≤1.0, and it may be to satisfy 0.7 mm≤interval A≤0.9 mm. In addition, the developing agent carrier 21, the latent image carrier 40, and the roll-shaped member 26 may satisfy the relation of 0≤interval B/interval A≤0.8, and may satisfy, the relation of 0<interval B/interval A≤0.7.

The developing agent carrier 21, the latent image carrier 40, and the roll-shaped member 26 may be disposed to satisfy the relation of interval C/interval A≥1.4, may be the relation of interval C/interval A≥1.5, and may be the relation of interval C/interval A≥1.6. The relation of interval C/interval A≥1.4 is satisfied at least in the proximity of the roll-shaped member 26. The proximity of the roll-shaped member 26 means, for example, the spike-standing developing agent by the magnetic force of the magnetic pole (second magnetic pole 70B) located on the downstream side in the rotational direction of the developing sleeve 21*a* of the roll-shaped member 26 is in contact with the developing case 24 (upper case wall 24*a*). When the developing sleeve 21*a* is rotated, the magnetic force component of the second magnetic pole 70B in the normal line direction of the developing agent carrier 21 becomes strong, so that the developing agent becomes a spike-standing shape, and then, the magnetic force component of the second magnetic pole 70B in the normal line direction of the developing agent carrier 21 is weakened, so that the shape of the spike-standing developing agent is laid down. When the magnetic force component of the second magnetic pole 70B in the normal line direction of the developing agent carrier 21 weakens and the spike-standing developing agent is laid down, the spike-standing developing agent is not in contact with the developing case 24 (upper case wall 24*a*). For this reason, at least, the relation of interval C/interval A≥1.4 needs to be satisfied upto the position where the second magnetic pole 70B component becomes weak in the normal line direction of the developing agent carrier 21.

The interval B between the latent image carrier 40 and the roll-shaped member 26 may be 1.0 mm or less (interval B s 1.0 mm), may be 0.9 mm or less, may be 0.7 mm or less. The interval B between the latent image carrier 40 and the roll-shaped member 26 may be greater than 0 (0 mm<interval B).

Figure 5:
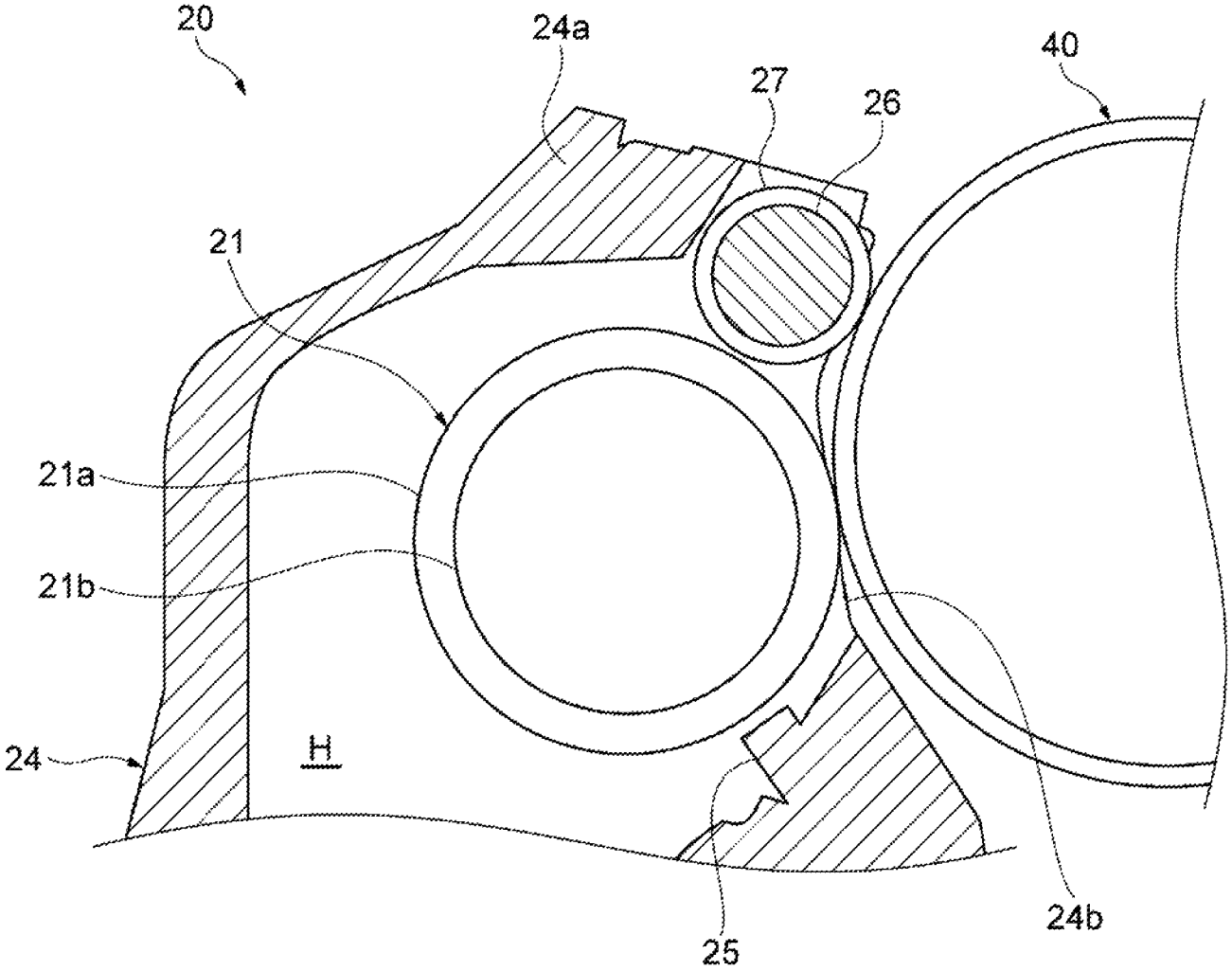
FIG. 5 is a schematic cross-sectional view of a developing device according to another example of the disclosure.
Figure 6:
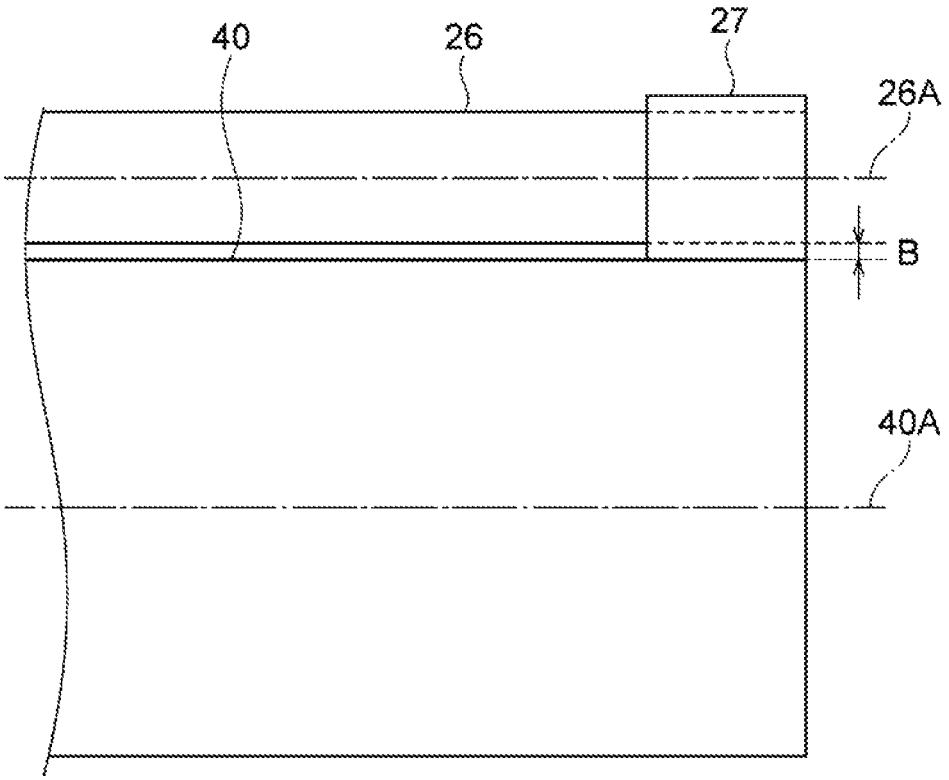
FIG. 6 is a view to describe a relation between the latent image carrier and the roll-shaped member of the developing device as illustrated in FIG. 5.

The positioning structure of the roll-shaped member 26 with respect to the latent image carrier 40 is not particularly limited. For example, the positioning structure shown in FIGS. 5 and 6 can be used. In the positioning structure of FIGS. 5 and 6, both ends of the roll-shaped member 26 are interleaved to the cylindrical member 27 and the cylindrical member 27 is in contact with the surface of the latent image carrier 40. In this case, the thickness of the cylindrical member 27 is the interval B between the latent image carrier 40 and the roll-shaped member 26.

As described above, according to the example, the roll-shaped member 26 which faces the developing agent carrier 21 and the latent image carrier 40 is provided, and a sucking air stream for sucking the scattered toner into the developing case 24 is generated between the gap between the developing agent carrier 21 and the roll-shaped member 26, and the gap between the latent image carrier 40 and the roll-shaped member 26. Since the roll-shaped member 26 has a circular cross-section, it is possible to reduce the area in which the gap is small. Therefore, the pressure loss of the suction air flow in these gaps can be reduced, and the scattered toner can be effectively recovered in the developing case 24.

Hereinbelow, the example of the disclosure having the roll-shaped member 26 is compared to the related art which does not have the roll-shaped member as a comparative example.

EXAMPLE OF THE DISCLOSURE

As an example of the disclosure, the developing device 20 shown in FIG. 2 is used. In an example of the disclosure, the interval A is set to be 0.8 mm, the interval B is 0.5 mm, the interval B/interval A is 0.625, the interval C is 2 mm, the interval C/interval A is 2.5.

Comparative Example of Related Art

Figure 7:
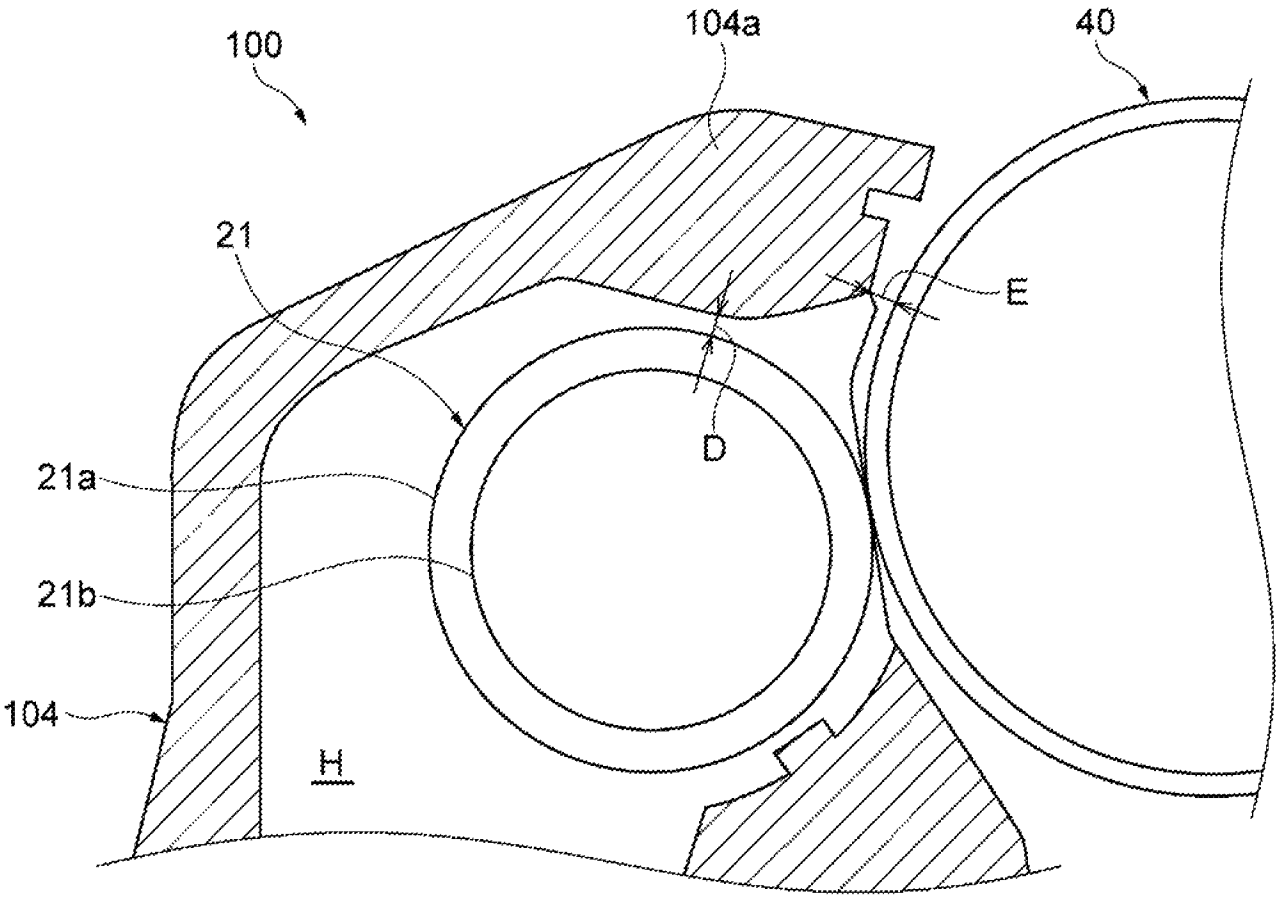
FIG. 7 is a schematic cross-sectional view of the developing device of a comparative example.

As shown in FIG. 7, the developing device 100 of the comparative example according to the related art (hereinafter collectively referred to as comparative example) does not have the roll-shaped member 26 of the example of the disclosure. The interval D between the developing agent carrier 21 in the comparative example and the case upper wall 104*a* of the developing case 104 is set to be the same as interval A between the developing agent carrier 21 and the roll-shaped member 26 in the example of the disclosure. In the comparative example, the interval E between the latent image carrier 40 and the case upper wall 104*a* of the developing case 104 is set to be same as the interval B between the latent image carrier 40 and the roll-shaped member 26 in the example of the disclosure. The case upper wall 104*a* is a portion that covers the upper portion of the developing agent carrier 21, but the wall surface thereof is not formed in a circular shape like the roll-shaped member 26 of the example of the disclosure.

Experiment 1

In the developing device 20 of the example of the disclosure and the developing device 100 of the comparative example, the amount of toner scattered and the amount of excessive discharge of the developing agent discharged from the developing agent outlet are measured. The toner scattering amount is measured by installing a toner collecting box, collecting the toner scattered between the latent image carrier 40 and the roll-shaped member 26 indicated by interval B, and measuring the weight of the collected toner. The result of the weight measurement per minute is defined as the amount of toner scattered. In the measurement of the amount of excessive discharge of the developing agent, the developing agent discharged from the developing agent outlet is collected, and the collected developing agent is weighed. The result of weighing per minute is defined as the amount of excessive discharge of the developing agent. The measurement results are shown in FIGS. 8 and 9.

Figure 8:
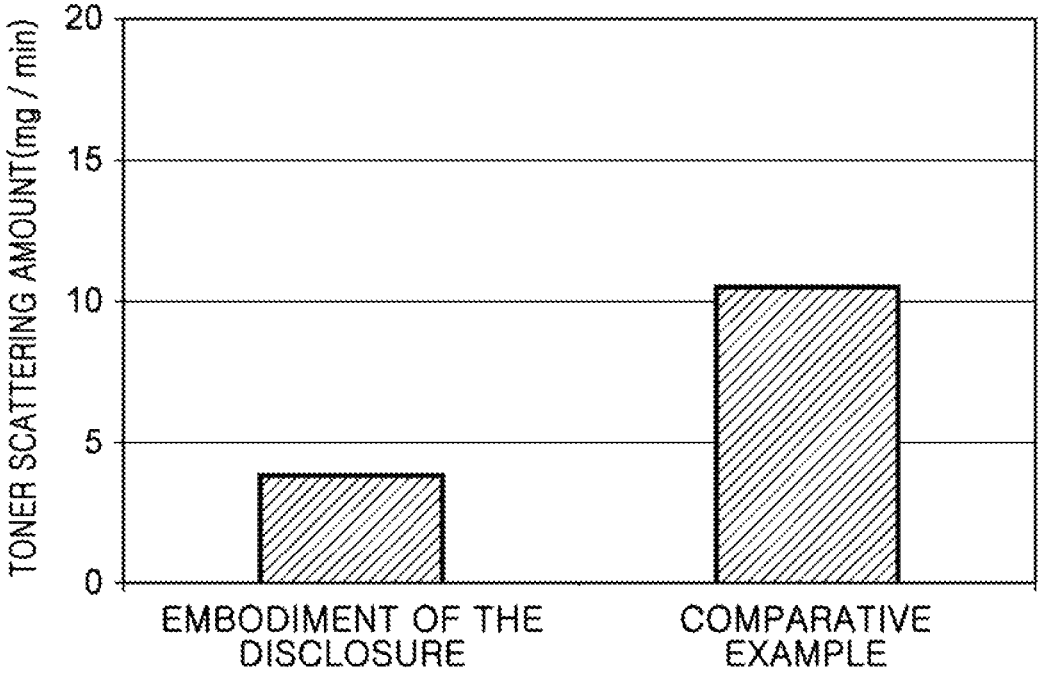
FIG. 8 is a graph illustrating a toner scattering amount of an example of the disclosure and a comparative example.
Figure 9:
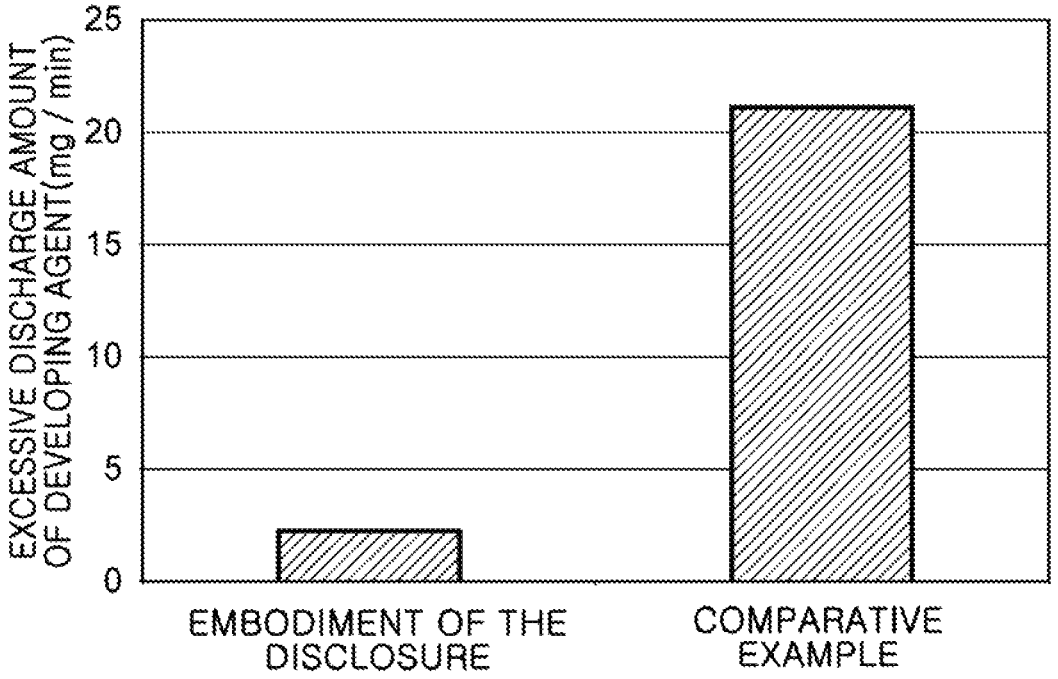
FIG. 9 is a graph illustrating an excessive discharge amount of the developing agent of an example of the disclosure and a comparative example.

As shown in FIG. 8 and FIG. 9, in the example of the disclosure, the toner scattering amount and the amount of excessive discharge of the developing agent are remarkably smaller than those of the comparative example. As described above, by providing the roll-shaped member 26, the area where the gap (interval A) between the developing agent carrier 21 and the roll-shaped member 26 is narrowed is reduced and the pressure loss of the suction air flow in the interval A can be reduced. In addition, by reducing the area in which the gap (interval B) between the roll-shaped member 26 and the latent image carrier 40 is narrowed, pressure loss of the sucking area in the interval B can be reduced, and the toner scattering amount and the amount of excessive discharge of the developing agent can be reduced.

As a specific example, as shown in FIG. 4, the area through which the suction air flow passes through the gap (interval A) between the roll-shaped member 26 and the developing agent carrier 21 of the disclosure formed to be smaller than the area shown in FIG. 7 through which the suction air flow passes through the gap (interval D) between the developing agent carrier 21 and the case upper wall 104*a* in the illustrated comparative example. Therefore, the pressure loss of the suction air flow which passes through the interval A is less than the suction air flow which passes through the interval D.

Thus, the disclosure can more effectively recover the scattered toner into the developing case 24. In addition, since the area of the developing agent transferred from the developing agent carrier 21 in contact with the developing case 24 can be reduced, the toner scattering due to the contact can also be reduced. Further, since the air flowing through the interval A spreads at the interval C, the air velocity is lowered and the air velocity of the air discharged to the ADR is also lowered, so that the amount of excessive discharge can be remarkably suppressed.

Experiment 2

In the developing device 20 according to an example of the disclosure, the relation between the interval A, which is a distance between the developing agent carrier 21 and the roll-shaped member 26, and the toner scattering amount is examined. The result is as illustrated in FIG. 10.

Figure 10:
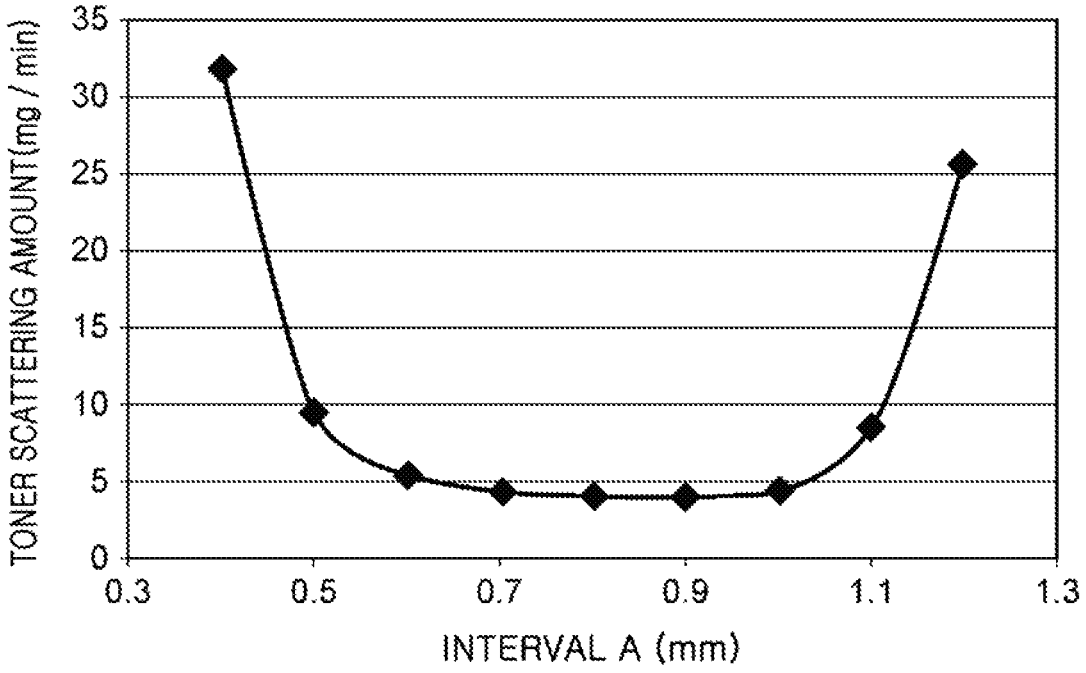
FIG. 10 is a graph illustrating a relation between the interval A and the toner scattering amount.

As shown in FIG. 10, the toner scattering amount is small in the range where the interval A is 0.5 mm or more and 1.1 mm or less, but when the interval A is less than 0.5 mm or greater than 1.1 mm, the toner scattering amount is increased, since in the case when the interval A is less than 0.5 mm, the pressure loss of the suction air flow in the gap between the developing agent carrier 21 and the roll-shaped member 26 becomes larger, and toner is not able to be recollected in the developing case efficiently. In addition, when the interval A is larger than 1.1 mm, it is considered that the toner scattering amount is increased by generating air flow in the direction opposite to the suction air flow in the gap between the developing agent carrier 21 and the roll-shaped member 26.

In the example of the disclosure, by satisfying the relation of 0.5 mm≤interval A≤1.1 mm, the pressure loss of the suction air flow generated between the developing agent carrier 21 and the roll-shaped member 26 is reduced, and the toner can be efficiently recollected into the developing case 24. In addition, since the air velocity of the suction air flow is increased between, or mainly between, the developing agent carrier 21 and the roll-shaped member 26, and the air amount of the suction air flow remains unchanged, the excessive discharge of the developing agent from the developing agent discharge outlet can be suppressed.

Experiment 3

In the developing device 20 according to an example of the disclosure, the relation between the interval B/interval A and the toner scattering amount is examined. The result is as illustrated in FIG. 11.

Figure 11:
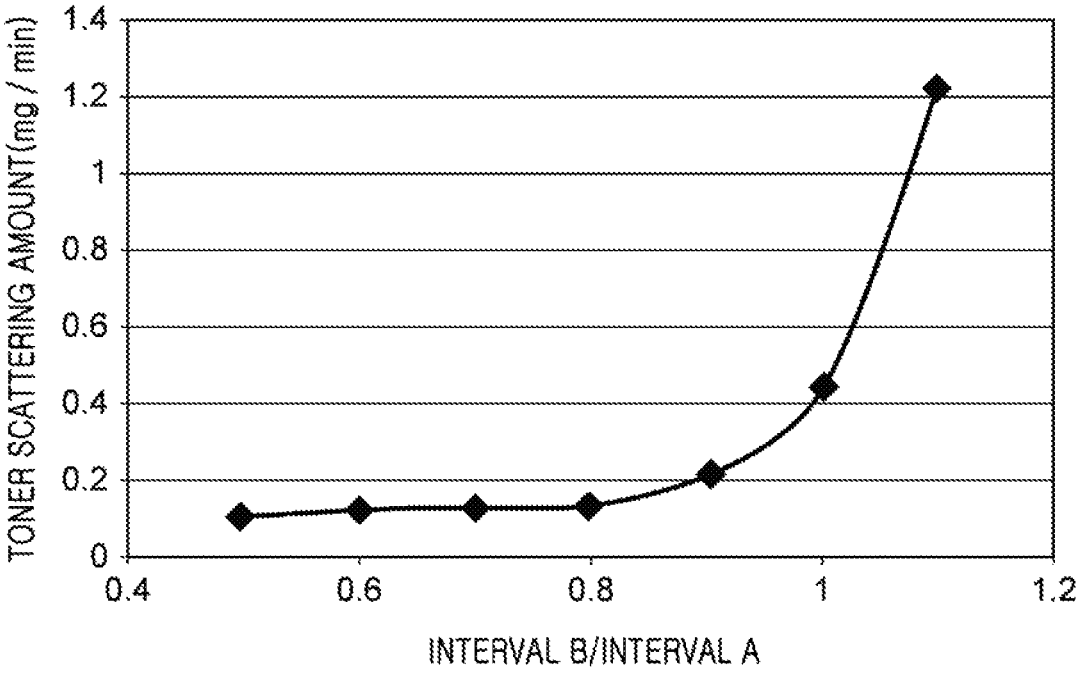
FIG. 11 is a graph illustrating a relation between the interval B/interval A and the toner scattering amount.

As shown in FIG. 11, the toner scattering amount is small in the range of the interval B/interval A of 0.9 or less, but when the interval B/interval A is greater than 0.9, the toner scattering amount is increased. This may be due to the following reasons. In other words, a suction air flow is generated in the gap between the latent image carrier 40 and the roll-shaped member 26 due to the suction air flow generated in the gap between the developing agent carrier 21 and the roll-shaped member 26. However, if the gap B/interval A is greater than 0.9, due to the suction air flow generated in the gap between the developing agent carrier 21 and the roll-shaped member 26, sufficient suction airflow does not occur in the gap between the latent image carrier 40 and the roll-shaped member 26.

In the example of the disclosure, by satisfying the relation of 0<interval B/interval A≤0.9, it is possible to generate a sufficient suction air flow between the latent image carrier 40 and the roll-shaped member 26 for suppressing the scattering of the toner. Through this, scattering of the toner between the latent image carrier 40 and the roll-shaped member 26 can be suppressed.

Experiment 4

In the developing device 20 according to an example of the disclosure, the relation between the developing agent transfer amount and the toner scattering amount is examined. The result is as illustrated in FIG. 12.

Figure 12:
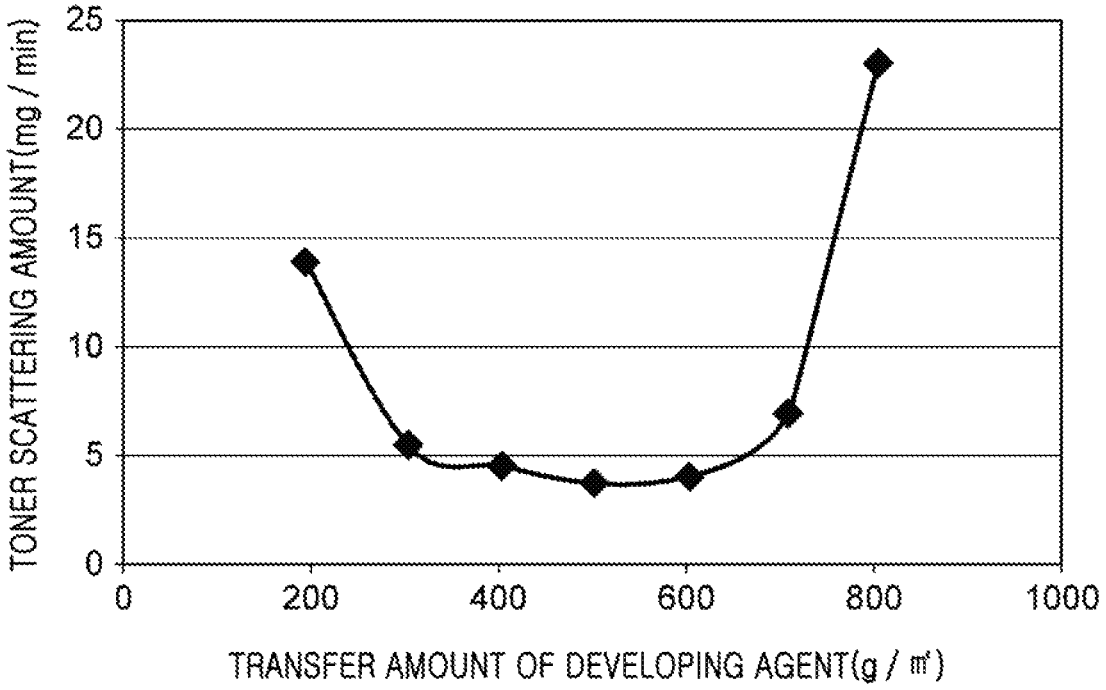
FIG. 12 is a graph illustrating a transfer amount of the developing agent and the toner scattering amount.

As shown in FIG. 12, the toner scattering amount is small when the developing agent transferring amount is 300 g/m$^2$ or more and 700 g/m$^2$ or less, but when the developing agent transferring amount is less than 300 g/m$^2$, or greater than 700 g/m$^2$, toner scattering amount is increased. This may be due to the following reasons. That is, the developing agent is carried on the developing agent carrier 21 to become a spike-standing shape, thereby generating a suction air flow between the developing agent carrier 21 and the roll-shaped member 26. Therefore, when the developing agent transferring amount is less than 300 g/m$^2$, it is considered that the suction air flow is not sufficiently generated and the toner cannot be sucked into the developing case 24. When the amount of developing agent transferring amount is greater than 700 g/m$^2$, the spike shape of the developing agent becomes too great, or the spike-shaped developing agent collides with the latent image carrier 40 and the roll-shaped member 26, and scattering of toner is promoted.

In the example of the disclosure, the transfer amount of the developing agent of the developing agent carrier 21 transferred in the developing area S is 300 g/m$^2$ or more so that sufficient suction air flow is generated and the toner can be sucked into the developing case 24. Meanwhile, the transfer amount of the developer of the developing agent carrier carried in the developing area is 700 g/m$^2$ or less, thereby suppressing the scattering of the toner by preventing that the size of the spike-standing developing agent attached to the developing agent carrier 21 becomes too large.

Experiment 5

In the developing device 20 according to an example of the disclosure, the relation between the interval B which is a distance between the latent image carrier 40 and the roll-shaped member 26 and the amount of toner scattering is examined. The results are shown in FIG. 13.

Figure 13:
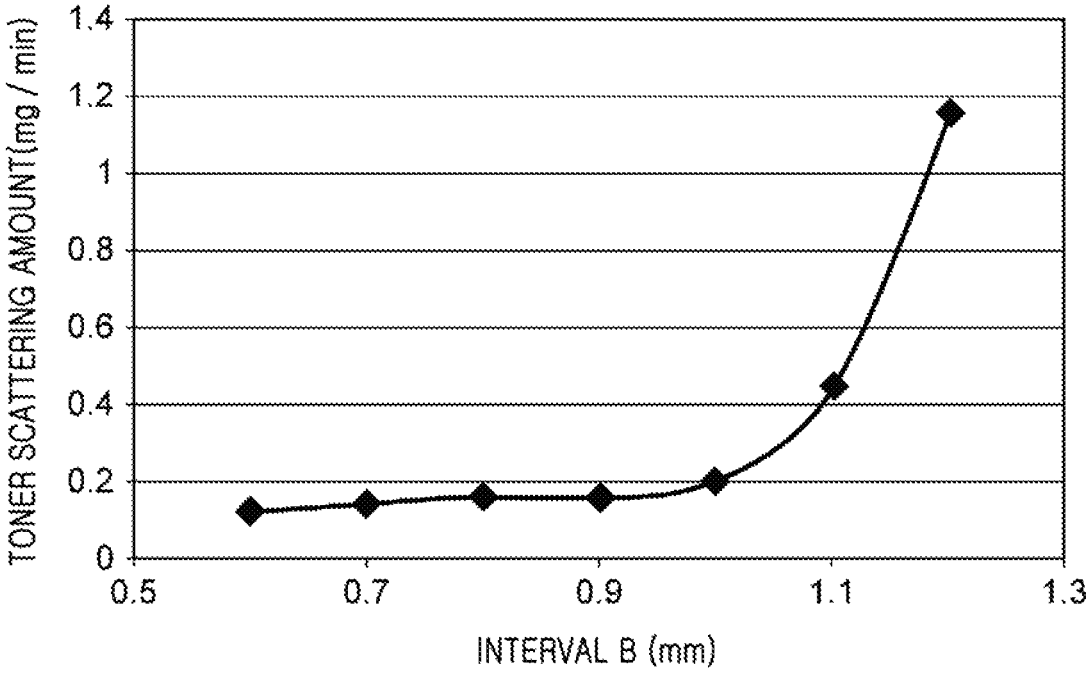
FIG. 13 is a graph illustrating a relation between the interval B and the toner scattering amount.

As shown in FIG. 13, when the interval B is 1.00 mm or less, the toner scattering amount is small, but when the interval B exceeds 1.00 mm, the toner scattering amount is increased. This is considered to be because, when the interval B exceeds 1.00 mm, it is not possible to generate suction air flow sufficient to suppress scattering of the toner between the latent image carrier 40 and the roll-shaped member 26.

In the example of the disclosure, the interval B between the latent image carrier 40 and the roll-shaped member 26 is set to 0 mm<interval B≤1.0 mm, and it is possible to generate an suction air flow sufficient to suppress the scattering of the toner. As a result, scattering of the toner between the latent image carrier 40 and the roll-shaped member 26 can be suppressed.

Experiment 6

In the developing device 20 according to an example of the disclosure, the relation between the interval C/interval A and the toner scattering amount is examined. The results are shown in FIG. 14.

Figure 14:
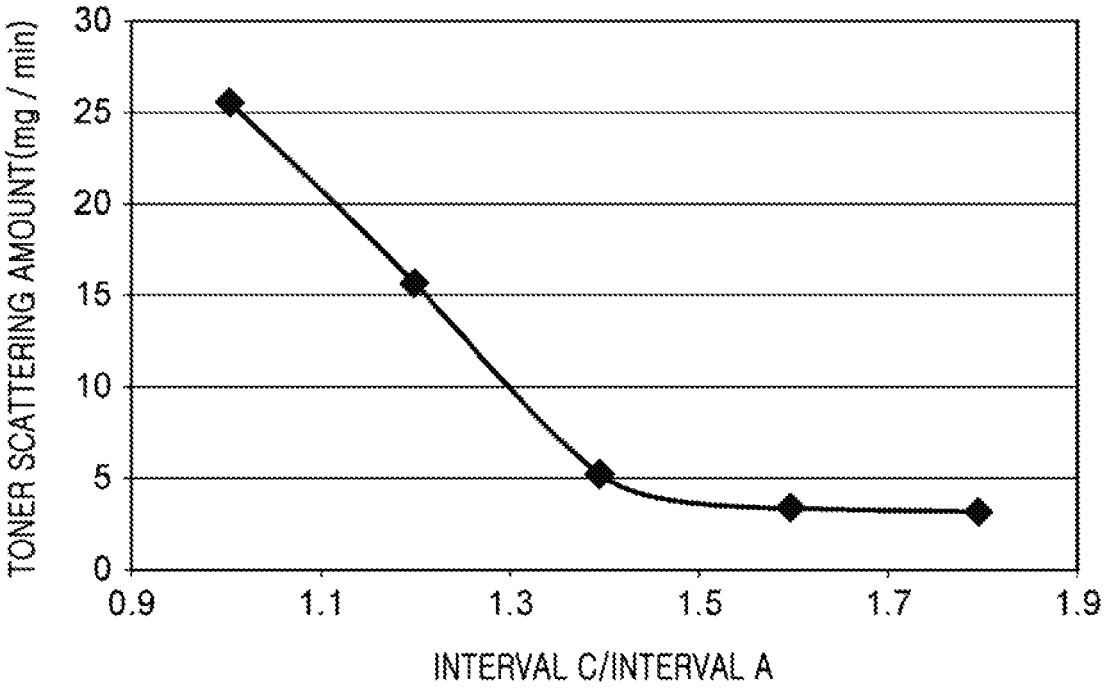
FIG. 14 is a graph illustrating a relation between interval C/interval A and the toner scattering amount.

As shown in FIG. 14, when the interval C/interval A is 1.4 or more, the toner scattering amount is small, but when the interval C/interval A is less than 1.4, the toner scattering amount is increased. This is considered to be because when the interval C/interval A is less than 1.4, the pressure loss of the air flow sucked into the developing case 24 becomes large and the toner becomes difficult to be sucked into the developing case 24. In this example, since the pressure loss of the air flow sucked into the developing case 24 can be reduced by satisfying the relation of the interval C/interval A≥1.4, the toner can be efficiently sucked to the developing case 24.

Experiment 7

In the developing device 20 according to an example of the disclosure, the relation between the angle of dislocation of the roll-shaped member 26 and the toner scattering amount with respect to the inter-pole central position CP (in the inter-pole between the first magnetic pole 70A and the second magnetic pole 70B, the position at which the absolute value of the magnetic force component in the normal line direction of the roll-shaped member 26 becomes the minimum value) is examined. The results are shown in FIG. 15.

Figure 15:
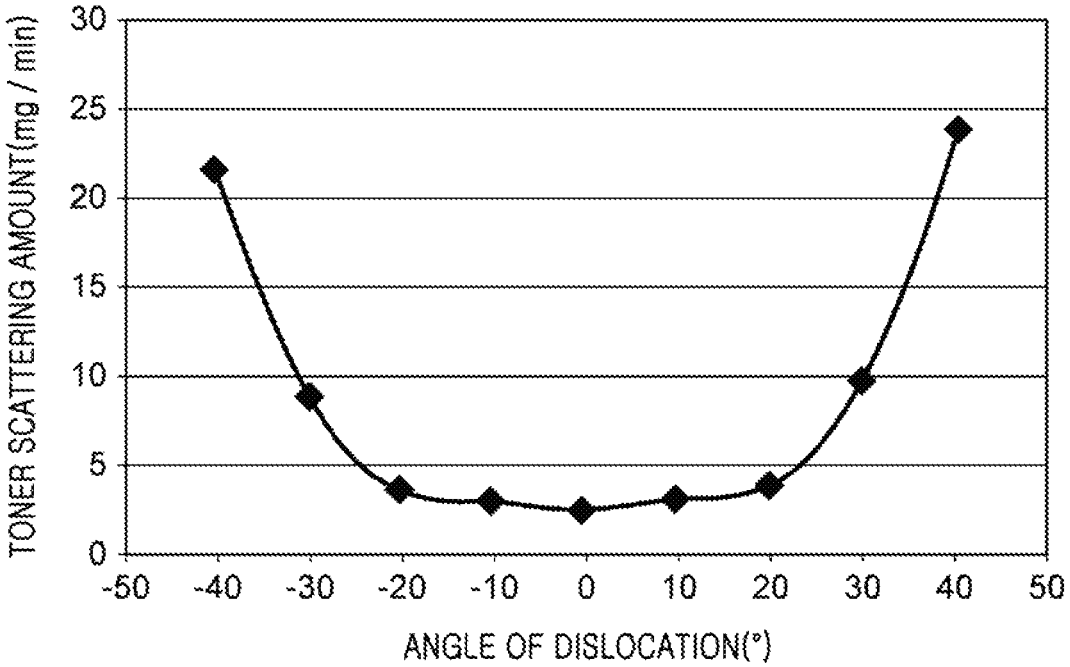
FIG. 15 is a graph illustrating a relation between a dislocation angle of the roll-shaped member to an inter-pole central position and the toner scattering amount.

As shown in FIG. 15, when the angle of dislocation of the roll-shaped member 26 with respect to the inter-pole central position CP is within +20°, the amount of toner scattering is small, but when the angle of dislocation of the roll-shaped member 26 is larger than ±20°, the toner scattering amount is increased. This may be due to the following reasons.

That is, the inter-pole between the first magnetic pole 70A and the second magnetic pole 70B is a position where the spike-standing developing agent is laid down. Therefore, if the angle of the dislocation of the roll-shaped member 26 with respect to the inter-pole central position CP is larger than ±20°, it becomes easy for the spike-standing developing gent to be in contact with the developing agent carrier 21 and toner scattering is promoted.

In the example of the disclosure, the roll-shaped member 26 is disposed between the first magnetic pole 70A and the second magnetic pole 70B, so that a chance that the developing agent carried on the developing agent carrier 21 is in contact with the roll-shaped member 26 may be reduced. This makes it possible to suppress the scattering of the toner caused by the contact of the developing agent carried on the developing agent carrier 21 to the roll-shaped member 26.

Further, by disposing the roll-shaped member 26 within a range of ±20° in the circumferential direction of the developing agent carrier 21 with respect to the center of the gap between the poles, it is possible to reduce the spike shape of the developing agent and the contact amount with the developing agent carrier 21. Thus, scattering of the toner can be suppressed while improving the degree of freedom of placement and workability of the roll-shaped member 26.

Experiment 8

In the developing device 20 according to an example of the disclosure, when the roll-shaped member 26 is made of a non-magnetic member and the roll-shaped member 26 is made of a magnetic member, the toner scattering amount is measured respectively. The results are shown in FIG. 16.

Figure 16:
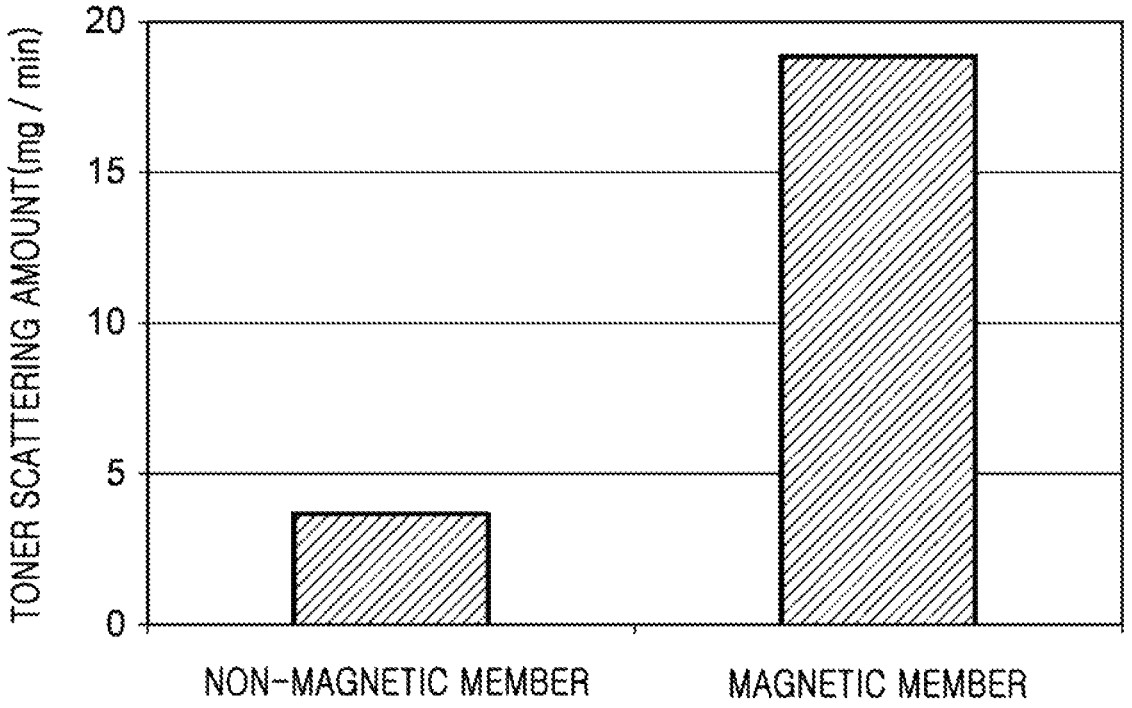
FIG. 16 is a graph illustrating the toner scattering amount in the roll-shaped member composed of a non-magnetic material and a magnetic material.

As shown in FIG. 16, when the roll-shaped member 26 is made of a non-magnetic member, the toner scattering amount is small. However, when the roll-shaped member 26 is made of a magnetic member, toner scattering amount is increased. This is because when the roll-shaped member 26 is made of a magnetic member, the roll-shaped member 26 is magnetized by the magnetic force of the developing agent carrier 21 and the developing agent is adhered to the roll-shaped member 26 and suction air flow is inhibited.

In this example, by making the roll-shaped member 26 non-magnetic, it can be suppressed that the roll-shaped member 26 is magnetized by the magnetic force of the developing agent carrier 21 and the developing agent is attached to the roll-shaped member. This makes it possible to prevent the suction air flow from being suppressed by attaching the developing agent to the roll-shaped member 26 and to prevent the toner adhering to the roll-shaped member 26 from being attached to the latent image carrier 40 again.

Experiment 9

The relation between the arithmetic average roughness Ra of the surface of the roll-shaped member 26 and the toner scattering amount in the developing device 20 according to the example of the disclosure is examined. The results are shown in FIG. 17.

Figure 17:
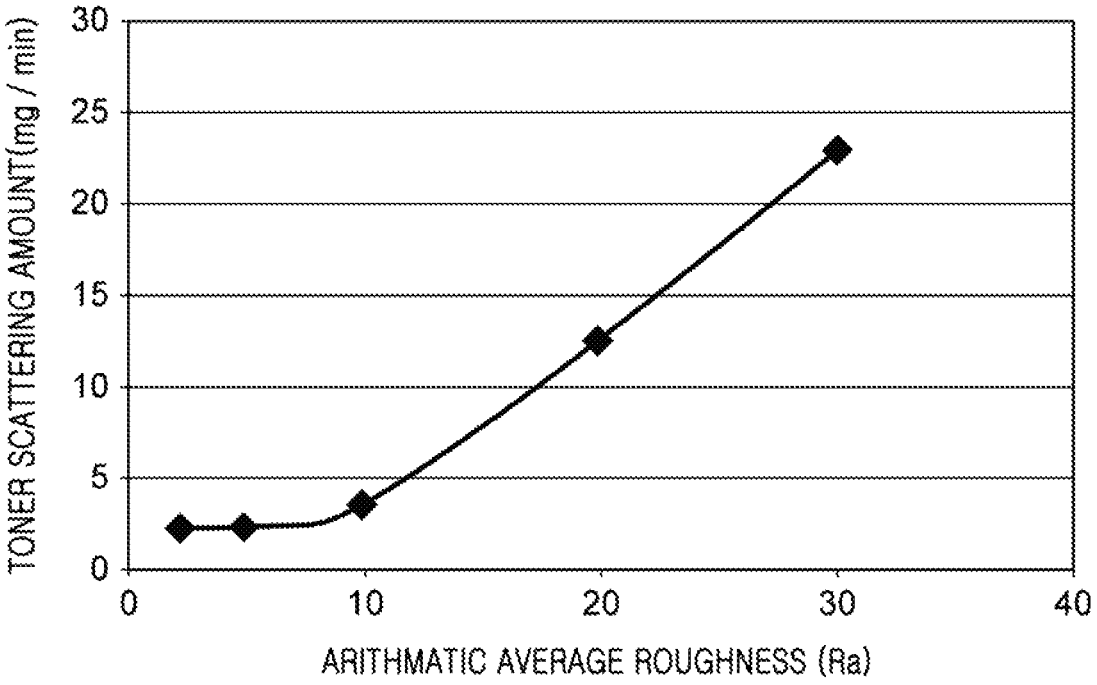
FIG. 17 is a graph illustrating a relation between the arithmetic average roughness and the toner scattering amount.

As illustrated in FIG. 17, when the arithmetic average roughness Ra of the surface of the roll-shaped member 26 is 10 μm or less, the toner scattering amount is small, but the arithmetic average roughness Ra of the surface of the roll-shaped member 26 is greater than 10 μm, the toner scattering amount is increased. It is considered that if the arithmetic average roughness Ra of the surface of the roll-shaped member 26 is larger than 10 μm, the air flow on the surface of the roll-shaped member 26 is disturbed, causing suction air flow to be suppressed.

In the example of the disclosure, the arithmetic average roughness Ra of the surface of the roll-shaped member 26 is 10 μm or less, thereby preventing the air flow of the surface of the roll-shaped member 26 from being disturbed, thereby preventing the suction air flow from being suppressed.

Experiment 10

Figure 18:
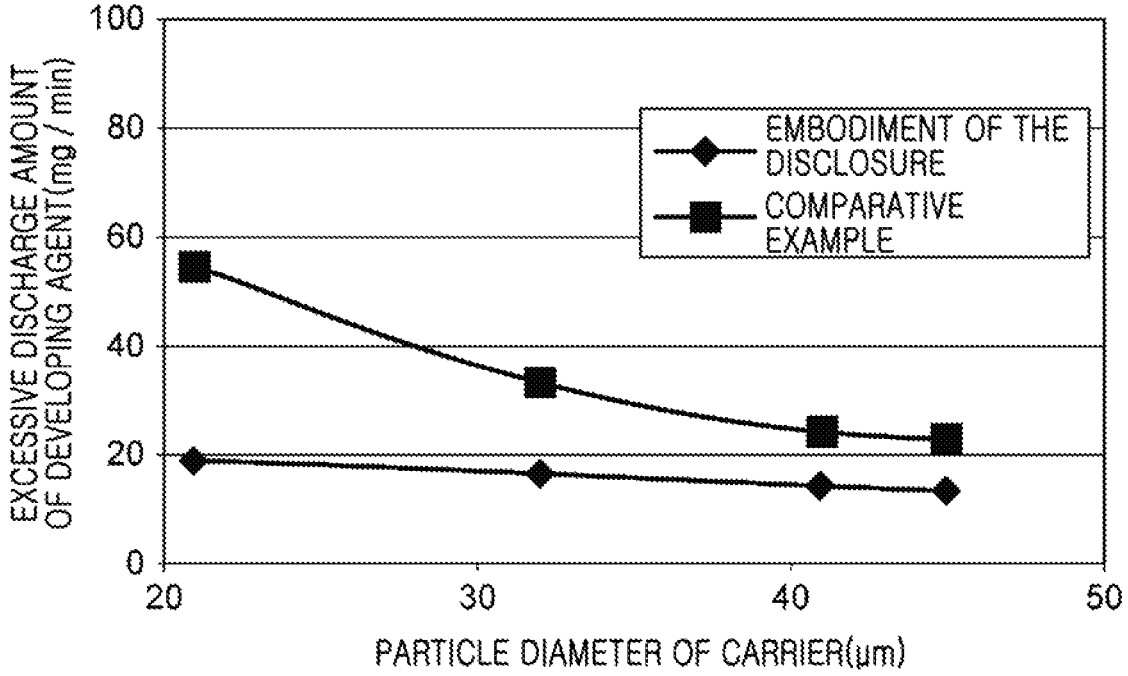
FIG. 18 is a graph illustrating a relation between a particle diameter of a carrier and the excessive discharge amount of the developing agent in one example of the disclosure and a comparative example.

In the developing device 20 according to an example of the disclosure and the developing device 100 of the comparative example, the relation between the average particle size of the carrier and the excessive discharge amount of the developing agent discharged from the developing agent discharge outlet is examined. The result is shown in FIG. 18. As shown in FIG. 18, in one example of the disclosure, the excessive discharge amount of toner is remarkably reduced as compared with the comparative example. Further, in one example of the disclosure, the excessive discharge amount of toner is not significantly changed by the average particle diameter of the carrier in the measured range. However, in the comparative example, as the average particle diameter of the carrier becomes smaller, the excessive discharge amount of toner tends to increase. Therefore, in the example as well, if the average particle diameter of the carrier is less than 20 μm, it can be considered that excessive discharge amount of toner is increased. However, in the example of the disclosure, the fluctuation of the excessive discharge amount of the developing agent to the average particle diameter of the carrier is smaller than that of the comparative example. Therefore, in one example of the disclosure, even if the average particle diameter of the carrier is less than 20 μm, it is considered that the excessive discharge amount of the developing agent can be suppressed significantly as compared to the comparative example.

In the example of the disclosure, the average particle size of the carrier is 20 to 40 μm or less, thereby preventing the developing agent from being excessively discharged from the developing case 24 with maintaining high quality of image.

In the above description, one example has been described as an example, but the example is not limited thereto and can be altered appropriately.

Figure 19:
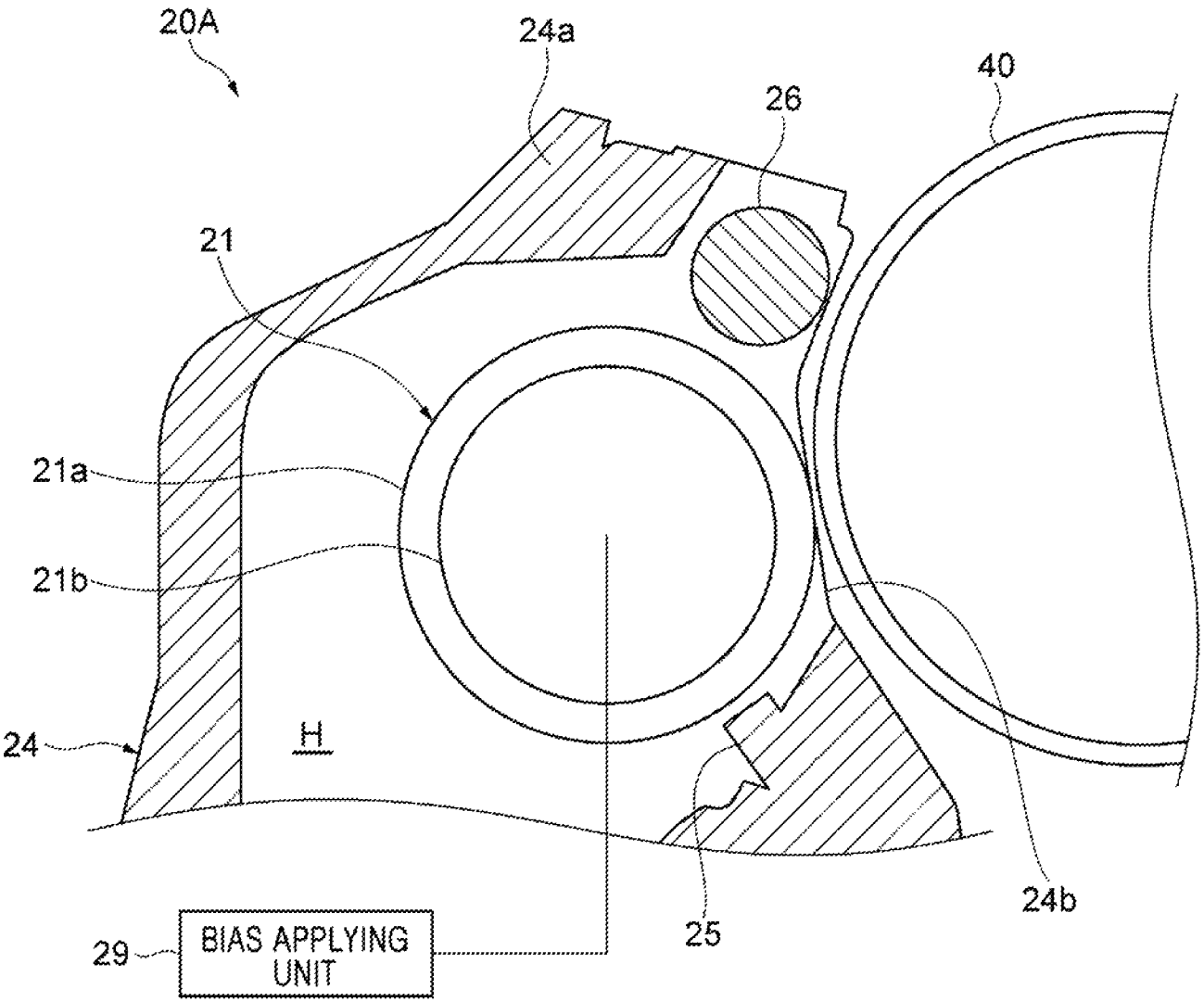
FIG. 19 is a schematic cross-sectional view of the developing device according to another example of the disclosure.

For example, as in a developing device 20A shown in FIG. 19, a bias applying unit 29 for applying a bias voltage to the roll-shaped member 26 may be provided. The bias applying unit 29 can be realized as one function of a controlling device composed of, for example, a Central Processing Unit (CPU), a Read Only Memory (ROM), and a Random Access Memory (RAM). Generally, by applying a bias voltage to the developing agent carrier 21, the bias applying unit 29 may have a function of a bias applying unit for applying a bias voltage to the developing agent carrier 21.

In this case, The bias applying unit 29 may apply a bias voltage having an absolute value larger than that of the bias voltage applied to the developing agent carrier 21 and a bias voltage having a smaller absolute value than a surface potential of the latent image carrier 40 to the roll-shaped member 26.

As described above, by applying a bias voltage to the roll-shaped member 26, it can be suppressed that the scattered toner is attached to the roll-shaped member 26. As a result, for example, it can be prevented that suction air flow is inhibited by attaching the developing agent to the roll-shaped member 26 and that toner attached to the roll-shaped member 26 is attached again to the latent image carrier 40.

In addition, by applying a bias voltage having a greater absolute value than a bias voltage applied to the developing agent carrier 21 to the roll-shaped member 26, it can be suppressed that the scattered toner or carrier is attached to the roll-shaped member 26. As a result, for example, it can be prevented that suction air flow is inhibited by attaching toner or carrier to the roll-shaped member 26, and it can be suppressed that the toner attached to the roll-shaped member 26 is reattached to the latent image carrier 40. In addition, by applying a bias voltage having a smaller absolute value than the surface potential of the latent image carrier to the roll-shaped member 26, it can be suppressed that the electrostatic latent image carried on the latent image carrier 40 is disturbed.

In addition, the roll-shaped member 26 can be rotated about the central axis 26A. Therefore, if the developing agent is attached to the roll-shaped member 26, it can be suppressed that the developing agent is piled at a certain portion of the roll-shaped member 26, as the roll-shaped member 26 is rotated. In addition, the developing agent attached to the roll-shaped member 26 is removed by the suction air flow, and as the roll-shaped member 26 is rotated, the developing agent attached to the entire circumference of the roll-shaped member 26 can be removed by a suction air flow.

In this case, the rotation direction of the roll-shaped member 26 is not particularly limited, and can be in the same direction as the direction of rotation of the developing sleeve 21*a*, and can be in the opposite direction. The rotation speed of the roll-shaped member 26 is not particularly limited, but the rotation speed to the extent that toner may be not too sucked into the developing case 24 by the air flowing along the roll-shaped member 26.

What is claimed is:

1. A developing device comprising:

a latent image carrier to form an electrostatic latent image on a surface of the latent image carrier;

a developing agent carrier to carry a developing agent including toner on a surface of the developing agent carrier, the developing agent carrier facing the latent image carrier; and a roll-shaped member facing the developing agent carrier to form a first gap between the developing agent carrier and the roll-shaped member and facing the latent image carrier to form a second gap between the latent image carrier and the roll-shaped member, the second gap narrower than the first gap, to form a suction air flow through the first gap and the second gap to suction toner particles scattered to the first gap between the roll-shaped member and the developing agent carrier and to the second gap between the roll-shaped member and the latent image carrier.

2. The developing device of claim 1, wherein a first interval (interval A) of the first gap between the roll-shaped member and the developing agent carrier and a second interval (interval B) of the second gap narrower than the first qap satisfy relations of $$0.5\ \text{mm} \leq \text{interval } A \leq 1.1\ \text{mm and}$$

$$0 \leq \text{interval } B/\text{interval } A\ 0.9.$$

3. The developing device of claim 2, wherein the developing agent carrier is to transfer the developing agent to a developing area where the developing agent carrier faces the latent image carrier to transfer the developing agent to develop the electrostatic latent image on the latent image carrier, and wherein a transfer amount of the developing agent that is transferred to the developing area from the developing agent carrier is 300 g/m$^2$ or more and 700 g/m$^2$ or less.

4. The developing device of claim 1, wherein the developing device further comprises a carrying amount regulating member to regulate a carrying amount of the developing agent that is carried on the developing agent carrier.

5. The developing device of claim 2, wherein the second interval is more than 0 mm and 1.0 mm or less.

6. The developing device of claim 2, further comprising a developing case to accommodate the developing agent;

wherein the developing agent carrier is to carry a developing agent from the developing case; and wherein a third interval (interval C) between the developing agent carrier and the developing case and the first interval (interval A) satisfies a relation of:

$$\text{interval } C/\text{interval } A \geq 1.4.$$

7. The developing device of claim 1, wherein the developing agent carrier comprises:

a developing sleeve to form a surface layer of the developing agent carrier; and a magnet to be disposed inside the developing sleeve and includes a plurality of magnetic poles in a circumferential direction, wherein the plurality of magnetic poles includes:

a first magnetic pole adjacent to a circumferential direction, and a second magnetic pole having a polarity opposite to the first magnetic pole, and wherein the roll-shaped member is positioned at a gap between the first magnetic pole and the second magnetic pole.

8. The developing device of claim 7, wherein the roll-shaped member is positioned within a range of ±20°, in a circumferential direction of the developing agent carrier, from a position in which an absolute value of a magnetic force component in a normal line direction of the developing agent carrier becomes a minimum value in a gap between the first magnetic pole and the second magnetic pole.

9. The developing device of claim 1, wherein the roll-shaped member is made of a non-magnetic member.

10. The developing device of claim 1, wherein an arithmetic average roughness Ra of a surface of the roll-shaped member is 10 μm or less.

11. The developing device of claim 1, wherein an end of the roll-shaped member is interleaved to a cylindrical member that is in contact with a surface of the latent image carrier.

12. The developing device of claim 1, further comprising:

a bias applying unit to apply a bias voltage to the roll-shaped member.

13. The developing device of claim 12, wherein the bias applying unit is to apply, to the roll-shaped member, a bias voltage having an absolute value larger than a bias voltage applied to the developing agent carrier and a bias voltage having a smaller absolute value than a surface potential of the latent image carrier.

14. The developing device of claim 1, wherein the developing agent includes a carrier; and an average particle diameter of the carrier is 20 μm or more and 40 μm or less.

15. An image forming apparatus comprising:

a developing device including a latent image carrier to form an electrostatic latent image on a surface of the latent image carrier;

a developing agent carrier to carry a developing agent including toner on a surface of the developing agent carrier, the developing agent carrier facing the latent image carrier; and a roll-shaped member facing developing agent carrier to form a first gap between the developing agent carrier and the roll-shaped member and facing the latent image carrier to form a second gap between the latent image carrier and the roll-shaped member, the second qap narrower than the first qap, to form a suction air flow through the first gap and the second gap, to suction toner particles scattered to the first gap between the roll-shaped member and the developing agent carrier and the second gap between the roll-shaped member and the latent image carrier.

* * * * *